US007323056B2

(12) United States Patent
Horie et al.

(10) Patent No.: US 7,323,056 B2
(45) Date of Patent: Jan. 29, 2008

(54) COATING APPARATUS

(75) Inventors: Shigenari Horie, Hiroshima (JP); Masahiro Sugihara, Hiroshima (JP); Hiroshi Miura, Mihara (JP); Toshiaki Miyakura, Mihara (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 321 days.

(21) Appl. No.: 11/099,548

(22) Filed: Apr. 6, 2005

(65) Prior Publication Data

US 2005/0223974 A1 Oct. 13, 2005

(30) Foreign Application Priority Data

Apr. 7, 2004 (JP) ..... 2004-112927

(51) Int. Cl.
*B05C 1/08* (2006.01)

(52) U.S. Cl. ..... 118/227; 118/249; 118/255; 118/262; 118/63

(58) Field of Classification Search ..... 118/227, 118/249, 255, 256, 262, 63; 427/428.11, 427/428.14, 428.17, 348; 162/275
See application file for complete search history.

(56) References Cited

U.S. PATENT DOCUMENTS 5,370,735 A 12/1994 Beisswanger
6,309,463 B1 * 10/2001 Hess et al. ..... 118/302
6,613,386 B1 * 9/2003 Kustermann ..... 427/299

FOREIGN PATENT DOCUMENTS

| | | |
|---|---|---|
| JP | 6-238219 | 8/1994 |
| JP | 8-144196 | 6/1996 |
| JP | 2002-263549 | 9/2002 |
| JP | 2003-326210 | 11/2003 |
| JP | 2003-340334 | 12/2003 |
| WO | 03/074192 | 9/2003 |

* cited by examiner

*Primary Examiner*—Laura Edwards
(74) *Attorney, Agent, or Firm*—Wenderoth, Lind & Ponack, L.L.P.

(57) ABSTRACT

A coating apparatus is provided in which entrained air flow of an applicator roll and a web is removed and occurrences of misting and coating irregularity are suppressed to thereby realize a uniform coating liquid film and a uniform coating state. A coating apparatus includes an applicator roll arranged to abut on another roll so as to form a nip portion therebetween and to transfer a coating liquid to be coated on a surface of a web passing through the nip portion. The coating apparatus further includes a coater head provided on an upstream side of the nip portion in a rotational direction of the applicator roll so as to supply the coating liquid onto a surface of the applicator roll and a boundary air remover provided between the nip portion and the coater head on the upstream side of the nip portion so as to prevent air from entering the nip portion. The boundary air remover includes a box part having an ejector ejecting an ejector gas on the surface of the applicator roll toward a direction reverse to the rotational direction of the applicator roll and also comprises a blade. The box part is constructed so as to cover a portion of the applicator roll.

21 Claims, 10 Drawing Sheets

COATING APPARATUS

BACKGROUND OF THE INVENTION

1. Field of the Invention

The present invention relates to a coating apparatus coating a coating liquid on a web surface.

2. Description of the Related Art

A conventional coating apparatus will be outlined below based on FIGS. 9 and 10. FIG. 9 is a schematic side view of a prior art example of a coating apparatus, as disclosed by the Japanese laid-open patent application 2002-263549 as Patent Document 1 (pages 4 and 6, FIGS. 1 and 5). The coating apparatus of FIG. 9 is constructed such that two applicator rolls are provided abutting on each other so as to form a nip portion therebetween and films of a coating liquid applied to surfaces of the two applicator rolls are transferred onto both sides of a web passing through the nip portion. FIG. 10 is a schematic side view of another prior art example of a coating apparatus.

In FIG. 9, a lower applicator roll 2*a* and an upper applicator roll 2*b* are opposedly provided so as to abut on each other and so as to form a nip portion 4 therebetween. A web 1 of paper or the like transferred from a previous process passes through the nip portion 4 to thereby be coated with a coating liquid and then, via a turn bar (an air levitating type non-contact turn bar) 6 that transfers the web 1 while the web 1 is being levitated by air, enters a drying device 40. The applicator rolls 2*a*, 2*b* comprise roll bodies 21*a*, 21*b*, respectively, made of a metal such as steel or the like, and elastic sheets 22*a*, 22*b*, respectively, of rubber or the like applied to outer circumferential surfaces of the roll bodies 21*a*, 21*b*, and rotate with a circumferential velocity the same as a running velocity of the web 1. On an upstream side of the nip portion 4 in respective rotational directions of the applicator rolls 2*a*, 2*b*, a lower coater head 3*a* and an upper coater head 3*b*, respectively, are provided as devices supplying the coating liquid onto outer surfaces of the respective elastic sheets 22*a*, 22*b*.

The respective coater heads 3*a*, 3*b* as coating liquid supply devices comprise metering devices including coating liquid supply pipings, metering rods, blades, etc. (not shown). When the coating liquid is sufficiently supplied onto the surfaces of the applicator rolls 2*a*, 2*b* from the coater heads 3*a*, 3*b*, the metering rods provided at outlets of the coater heads 3*a*, 3*b* are pressed against the surfaces of the applicator rolls 2*a*, 2*b* so that coating liquid films of a predetermined film thickness are formed on the surfaces of the applicator rolls 2*a*, 2*b*.

While the web 1 passes through the nip portion 4 where the applicator rolls 2*a*, 2*b* abut on each other, the coating liquid films formed on the surfaces of the applicator rolls 2*a*, 2*b* make contact with surfaces of respective sides of the web 1 and are transferred to be coated thereon. While the web 1 coated with the coating liquid is being transferred toward the drying device 40 via the run bar 6, the turn bar 6 supports the web 1 to be levitated from the surface of the device by the force of air so that the surface of the web 1 may not make contact with a supporting member. Thus, the web 1 can be transferred into the drying device 40 without damaging a quality of the coated surfaces formed on the web 1 which are not yet dry.

On the other hand, when the coating liquid is transferred to be coated on the web 1, if the web 1 is of a water absorptive nature, such as paper or the like, elongation or contraction of the web 1 is caused by the absorption of water.

If the web 1 is arranged to linearly pass through the nip portion 4 in a tangential direction of both of the applicator rolls 2*a*, 2*b*, as shown by a dotted line in FIG. 9, as no such a device or member as to restrict a passing route of the web 1 that has passed through the nip portion 4 is provided in the way to the turn bar 6, a problem may be caused in that the web 1 that has elongated on a downstream side of the nip portion 4 runs sticking to the surface of any one of the lower and upper applicator rolls 2*a*, 2*b* by an adhesive action of the coating liquid. If the web 1 has a large width in an axial direction of the applicator rolls 2*a*, 2*b*, this sticking state becomes irregular in a width direction of the web 1 and a vibrating state may be caused. Especially, if the coating is to be done at a high speed, this irregular state begins to vary as time passes and this may lead to a very unstable situation.

As the result thereof, a coating irregularity called "peeled pattern" may be caused and also a "misting" phenomenon may arise in which the coating liquid becomes mist and scatters. If this phenomenon arises, the coating apparatus and the coated paper are contaminated and this may lead to an operation obstacle. Also, as a contact distance with which the web 1 makes contact with the applicator rolls 2*a*, 2*b* is as short as the nip portion 4 only (about 20 mm), contact and penetration of the coating liquid with and into the web 1 are often insufficient and this may invite a deterioration of the coating state and a generation of the misting phenomenon.

Hence, in the coating apparatus shown in FIG. 9, a roll side turn bar 5 of an air levitating type is provided on the downstream side of the nip portion 4 so that the web 1 immediately after passing through the nip portion 4 is kept supported on the surface of the upper applicator roll 2*b* and transferred. Also, a paper roll 7 is provided on the upstream side of the nip portion 4 in the running direction of the web 1 so that the web 1 immediately before entering the nip portion 4 is kept supported on the surface of the lower applicator roll 2*a* and transferred. At the roll side turn bar 5, like in the case of the turn bar 6, the web 1 is supported by being levitated from the surface of the device by the force of air so that the surface of the web 1 may not make contact with a supporting member and thus, the web 1 can be transferred without damaging the quality of the coated surfaces on the web 1 which are not yet dry.

That is, by the arrangement of the roll side turn bar 5 of an air levitating type, the web 1 immediately after passing through the nip portion 4 is kept supported on the surface of the upper applicator roll 2*b* and transferred to then be peeled off from the upper applicator roll 2*b* with a large peeling angle β formed between the web 1 and the surface of the upper applicator roll 2*b*. Thereby, the peeling action and the peeling position are stabilized and the coating irregularity, such as the peeled pattern for example, and the misting phenomenon can be prevented. Also, the contact distance of the web 1 in contact with the upper applicator roll 2*b* is elongated than in the case of the nip portion 4 only. Thereby, the penetration of the coating liquid into the web 1 is accelerated and the coating state is improved.

Also, by the arrangement of the paper roll 7, the web 1 immediately before entering the nip portion 4 is transferred being kept supported on the surface of the lower applicator roll 2*a*. Thereby, the contact distance of the web 1 in contact with the lower applicator roll 2*a* is elongated than in the case of the nip portion 4 only. Hence, the penetration of the coating liquid into the web 1 from the lower applicator roll 2*a* is accelerated, the coating state is improved and the misting phenomenon on the downstream side of the nip portion 4 is reduced.

Moreover, the contact distance of the web 1 in contact with the lower applicator roll 2*a* on the upstream side of the nip portion 4 and the contact distance of the web 1 in contact with the upper applicator roll 2*b* on the downstream side of the nip portion 4 can be set substantially equally to each other, so that an effect is obtained in that the coating states of both sides of the web 1 can be easily equalized.

Nevertheless, recently, there are large demands for coating apparatuses of more and more high speed, such as a web velocity of 2000 m/min or more for example. Thus, even in the conventional coating apparatus improved as mentioned above, if it is operated at the high speed, an entrained air flow of the web 1 is caused as well as an entrained air flow of the lower applicator roll 2*a* on the upstream side of the nip portion 4, and these entrained air flows enter between the web 1 and the lower applicator roll 2*a*. Thereby, the web 1 is levitated on the upstream side of the nip portion 4 to be prevented from making contact with the coating liquid on the lower applicator roll 2*a* and there arises a phenomenon that when the web 1 reaches the nip portion 4, it first makes contact with the coating liquid. Thus, there is a problem to nullify the effect of the paper roll 7 to urge the web 1 to make contact with the surface of the lower applicator roll 2*a* on the upstream side of the nip portion 4. Also, by the web 1 so making less contact with the lower applicator roll 2*a* on the upstream side of the nip portion 4, the transfer of the coating liquid onto one side of the web 1 on the lower applicator roll 2*a* side, that is, the lower side of the web 1 in FIG. 9, becomes deteriorated and a problem arises in that an irregularity of the coating state is caused between each side of the web 1. It is to be noted that these problems will likewise arise in such an arrangement of the coating apparatus that the arrangement of the devices of FIG. 9 is turned upside down.

While the above-mentioned prior art example is a coating apparatus in which the two applicator rolls arranged to abut on each other form the nip portion 4 and the web 1 passes through the nip portion 4 so that the coating liquid films formed on the two applicator rolls are transferred to be coated on both sides of the web 1, there is also a similar problem in such a coating apparatus as disclosed by the Japanese laid-open patent application 1996-144196 as Patent Document 2 (page 4, FIG. 1) in which the nip portion is formed between an applicator roll and a backing roll and coating is carried out on one side of the web 1.

FIG. 10 shows an example of such a coating apparatus. There, a curtain coating method is carried out such that a curtain die 51 as a coating liquid supply device forms a curtain-like form of a coating liquid falling so as to be supplied onto a circumferential surface of a rotating applicator roll 52 so that a uniform coating liquid film is formed thereon and, at a nip portion 54 between the applicator roll 52 and a backing roll 53, the coating liquid film is transferred onto a web 1 running being wound around the backing roll 53. Then, a surplus coating liquid is scraped off by a doctor plate 56. The web 1 is urged to be wound around the backing roll 53 by a guide roll 55 provided on the upstream side of the nip portion 54 and runs into the nip portion 54 via a wind breaking plate 57. The coating liquid is supplied from a coating liquid tank 59 by a coating liquid pump 58 to be sent to the curtain die 51 and supplied onto the applicator roll 52, as mentioned above, on the upstream side of the nip portion 54.

In the arrangement of the coating apparatus as mentioned above, entrained air flow on the circumferential surface of the applicator roll 52 is liable to enter the nip portion 54 and also entrained air flow on the web 1, despite the function of the wind breaking plate 57, often enters the nip portion 54 and this easily gives a bad influence on the coated state of the web 1. Hence, even in the coating apparatus in which the coating is carried out on one side of the web only, it is necessary to remove the entrained air flow on the web as well as on the applicator roll.

However, at present, a sufficiently improved coating apparatus has not yet been provided that is able to effectively remove not only the entrained air flow of the web but also the entrained air flow of the applicator roll. For example, the Japanese laid-open patent application 2003-326210 as Patent Document 3 (page 5, FIG. 2), that is a related invention to the present invention, relates to an improvement of the roll side turn bar 5 of an air levitating type as an improvement of the apparatus of the above-mentioned Patent Document 1.

SUMMARY OF THE INVENTION

In order to solve the problems in the conventional devices as mentioned above, it is an object of the present invention to provide a coating apparatus that is able to remove the entrained air flow of both of the web and the applicator roll, to suppress occurrences of mist and coating irregularity and to form a uniform coating state as well as to realize a coating uniformity between each of both sides of the web.

In order to achieve the above-mentioned object, the present invention provides coating apparatuses constructed by the following means (1) to (14):

(1) A first means is a coating apparatus comprising an applicator roll arranged to abut on another roll so as to form a nip portion therebetween and to transfer a coating liquid applied to a surface of the applicator roll to be coated on a surface of a web passing through the nip portion, characterized in that the coating apparatus further comprises a coater head provided on an upstream side of the nip portion in a rotational direction of the applicator roll so as to supply the coating liquid onto the surface of the applicator roll and a boundary air remover provided between the nip portion and the coater head on the upstream side of the nip portion so as to prevent air from entering the nip portion, the boundary air remover comprising an ejector ejecting an ejector gas onto the surface of the applicator roll toward a direction reverse to the rotational direction of the applicator roll.

(2) A second means is a coating apparatus as mentioned in the first means, characterized in that the ejector gas is steam.

(3) A third means is a coating apparatus as mentioned in the first means, characterized in that an ejecting direction of a nozzle of the ejector is in the range of 10° to 45° relative to a tangential direction of the applicator roll.

(4) A fourth means is a coating apparatus as mentioned in the first means, characterized in that the boundary air remover comprises a blade provided on the upstream side of the nip portion in a running direction of the web so as to elongate in a width direction of the web and to make contact with a side surface of the web that makes contact with the surface of the applicator roll.

(5) A fifth means is a coating apparatus as mentioned in the fourth means, characterized in that the boundary air remover comprises a box front plate closing a space between the ejector and the blade and a top plate portion formed by the portion of the web between a position where the web makes contact with the blade and a position where the web makes contact with the applicator roll so that the box front plate, the blade and the top plate portion form a box part between the nip portion and the ejector on the upstream side of the nip portion in the rotational direction of the applicator roll, the box part having a length larger than a width to be coated of the web and being arranged so as to cover a portion of the surface of the applicator roll along an axial direction of the applicator roll, and the box front plate and the ejector are provided closely to the applicator roll coated with the coating liquid with a gap being maintained therebetween so as not to make contact with each other.

(6) A sixth means is a coating apparatus as mentioned in the fourth means, characterized in that the boundary air remover comprises a box front plate closing a space between the ejector and the blade and a box top plate provided on a downstream side of the box front plate and connected to the box front plate so as to elongate toward a position where the web makes contact with the applicator roll so that the box front plate and the box top plate form a box part between the nip portion and the ejector on the upstream side of the nip portion in the rotational direction of the applicator roll, the box part having a length larger than a width to be coated of the web and being arranged so as to cover a portion of the surface of the applicator roll along an axial direction of the applicator roll, and the box front plate and the ejector are provided closely to the applicator roll coated with the coating liquid with a gap being maintained therebetween so as not to make contact with each other.

(7) A seventh means is a coating apparatus as mentioned in the fourth means, characterized in that the boundary air remover has the ejector provided as a first ejector and comprises, in place of the blade, a second ejector provided on the upstream side of the nip portion in the running direction of the web so as to eject an ejector gas onto the side surface of the web that makes contact with the surface of the applicator roll.

(8) An eighth means is a coating apparatus as mentioned in the seventh means, characterized in that an ejecting direction of a nozzle of the second ejector is in the range of 10° to 45° relative to the surface of the web.

(9) A ninth means is a coating apparatus as mentioned in the seventh means, characterized in that the boundary air remover comprises a front plate portion closing a space between the first ejector and the second ejector and a top plate portion formed by the portion of the web between a position where the web faces the second ejector and a position where the web makes contact with the applicator roll so that the front plate portion and the top plate portion form a box part between the nip portion and the first and second ejectors on the upstream side of the nip portion in the rotational direction of the applicator roll, the box part having a length larger than a width to be coated of the web and being arranged so as to cover a portion of the surface of the applicator roll along an axial direction of the applicator roll, and the front plate portion and the first ejector are provided closely to the applicator roll coated with the coating liquid with a gap being maintained therebetween so as not to make contact with each other and the second ejector is provided closely to the web with a gap being maintained therebetween so as not to make contact with each other.

(10) A tenth means is a coating apparatus as mentioned in any one of the fifth, sixth and ninth means, characterized in that the boundary air remover comprises a box end plate provided at each of both end portions of the box part in the axial direction of the applicator roll, the box end plate being provided closely to the applicator roll coated with the coating liquid with a gap being maintained therebetween so as not to make contact with each other.

(11) An eleventh means is a coating apparatus as mentioned in the tenth means, characterized in that the box end plate is provided movably in the axial direction of the applicator roll.

(12) A twelfth means is a coating apparatus as mentioned in the tenth means, characterized in that the boundary air remover comprises a vent hole provided on the box part and connected with a suction device so that gas in the box part is sucked out.

(13) A thirteenth means is a coating apparatus as mentioned in the tenth means, characterized in that the boundary air remover comprises a vent hole provided on the box part and connected with a steam supply device so that steam is supplied into the box part.

(14) A fourteenth means is a coating apparatus comprising two applicator rolls arranged to abut on each other so as to form a nip portion therebetween and to transfer a coating liquid applied to surfaces of the applicator rolls to be coated on a surface of a web passing through the nip portion, characterized in that an air levitating type turn bar is provided on a downstream side of the nip portion so that the web after passing through the nip portion is wound around the surface of one applicator roll of the two applicator rolls to be transferred, a paper roll is provided on an upstream side of the nip portion in a running direction of the web so that the web before entering the nip portion is wound around the surface of the other applicator roll of the two applicator rolls to be transferred and a boundary air remover is provided between the web and the other applicator roll on an upstream side of a position where the web makes contact with the surface of the other applicator roll so as to prevent air from entering the nip portion.

By employing the coating apparatuses of the above-mentioned first to fourteenth means of the present invention, the following functions and effects can be obtained:

(1) According to a first aspect of the invention, a coating apparatus comprising an applicator roll arranged to abut on another roll so as to form a nip portion therebetween and to transfer a coating liquid applied to a surface of the applicator roll to be coated on a surface of a web passing through the nip portion is constructed such that the coating apparatus further comprises a coater head provided on an upstream side of the nip portion in a rotational direction of the applicator roll so as to supply the coating liquid onto the surface of the applicator roll. The coating apparatus also includes a boundary air remover provided between the nip portion and the coater head on the upstream side of the nip portion so as to prevent air from entering the nip portion, the boundary air remover comprising an ejector ejecting an ejector gas onto the surface of the applicator roll toward a direction reverse to the rotational direction of the applicator roll. By this construction, an entrained air flow caused by a rotation of the applicator roll is blocked by the ejector gas ejected from the ejector to be prevented from entering between the web and the applicator roll. Hence, the coating liquid is not prevented from making contact with the web, a contact ability of the web to the applicator roll is enhanced, a coating irregularity and misting are reduced and a coating state of the web is enhanced.

(2) According to a second aspect of the invention, the coating apparatus as mentioned in the first aspect of the invention is constructed such that the ejector gas is steam. Hence, in addition to the function and effect of the first aspect of the invention, as there are usually plenty of steam sources in paper working plants, etc., a high usability of existing facilities is obtained. Moreover, such an effect is obtained that the coating liquid on the applicator roll is prevented from becoming dried and the contact ability of the web is enhanced by wetting of the steam.

(3) According to the third aspect of the invention, the coating apparatus as mentioned in the first aspect of the invention is constructed such that an ejecting direction of a nozzle of the ejector is in the range of 10° to 45° relative to a tangential direction of the applicator roll. Hence, in addition to the function and effect of the first aspect of the invention, the ejector gas collides with the entrained air flow caused by the applicator roll in the above-mentioned angular range and the entrained air flow can be effectively prevented.

(4) According to the fourth aspect of the invention, the coating apparatus as mentioned in the first aspect of the invention is constructed such that the boundary air remover comprises a blade provided on the upstream side of the nip portion in a running direction of the web so as to elongate in a width direction of the web and to make contact with a side surface of the web that makes contact with the surface of the applicator roll. Hence, in addition to the function and effect of the first aspect of the invention, not only the entrained air flow caused by the rotation of the applicator roll is blocked by the ejector gas but also the entrained air flow caused by the running of the web is blocked by the blade to be both prevented from entering between the web and the applicator roll and the coating liquid is not prevented from making contact with the web. Moreover, the contact ability of the web to the applicator roll is further enhanced, the coating irregularity and the misting are reduced and the coating state of the web is further enhanced.

(5) According to the fifth aspect of the invention, the coating apparatus as mentioned in the fourth aspect of the invention is constructed such that the boundary air remover comprises a box front plate closing a space between the ejector and the blade and a top plate portion formed by the portion of the web between a position where the web makes contact with the blade and a position where the web makes contact with the applicator roll so that the box front plate, the blade and the top plate portion form a box part between the nip portion and the ejector on the upstream side of the nip portion in the rotational direction of the applicator roll, the box part having a length larger than a width to be coated of the web and being arranged so as to cover a portion of the surface of the applicator roll along an axial direction of the applicator roll, and the box front plate and the ejector are provided closely to the applicator roll coated with the coating liquid with a gap being maintained therebetween so as not to make contact with each other. Hence, in addition to the function and effect of the fourth aspect of the invention, the side of the web facing the applicator roll on the upstream side of the nip portion is directed to the interior of the box part, not to the outside, and the entrained air flow is further effectively prevented from entering between the web and the applicator roll. Also, while a negative pressure is caused on the back side of the ejection of the ejector gas from the ejector, this negative pressure in the box part accelerates the web to make contact with the applicator roll. Further, by providing lower edge portions of the box front plate and the ejector closely to the applicator roll coated with the coating liquid with a gap being maintained therebetween so as not to make contact with each other, air inflow due to the negative pressure can be reduced and re-generation of the entrained air flow due to the inflow air can be prevented.

(6) According to the sixth aspect of the invention, the coating apparatus as mentioned in the fourth aspect of the invention is constructed such that the boundary air remover comprises a box front plate closing a space between the ejector and the blade and a box top plate provided on a downstream side of the box front plate and connected to the box front plate so as to elongate toward a position where the web makes contact with the applicator roll so that the box front plate and the box top plate form a box part between the nip portion and the ejector on the upstream side of the nip portion in the rotational direction of the applicator roll, the box part having a length larger than a width to be coated of the web and being arranged so as to cover a portion of the surface of the applicator roll along an axial direction of the applicator roll, and the box front plate and the ejector are provided closely to the applicator roll coated with the coating liquid with a gap being maintained therebetween so as not to make contact with each other. Hence, in addition to the function and effect of the fourth aspect of the invention, while a negative pressure is caused on the back side of the ejection of the ejector gas from the ejector, lower edge portions of the box front plate or the ejector and the box top plate are provided closely to the applicator roll coated with the coating liquid with a gap being maintained therebetween so as not to make contact with each other and thereby the air inflow can be reduced and re-generation of the entrained air flow due to the inflow air can be prevented. Also, in case where a portion of the box part is formed by the web itself, if the web is thin or a density of the web is small, air passes through the surface of the web to enter the box part and there is caused a problem to reduce the effect of providing the box part. But, as the box part is constructed comprising the box top plate separately from the web, there is caused no such problem.

(7) According to the seventh aspect of the invention, the coating apparatus as mentioned in the fourth aspect of the invention is constructed such that the boundary air remover has the ejector provided as a first ejector and comprises, in place of the blade, a second ejector provided on the upstream side of the nip portion in the running direction of the web so as to eject an ejector gas onto the side surface of the web that makes contact with the surface of the applicator roll. Hence, in addition to the function and effect of the invention of the fourth aspect of the invention, the entrained air flow caused by the rotation of the applicator roll is blocked by the ejector gas ejected from the first ejector and the entrained air flow caused by the running of the web is blocked by the ejector gas ejected from the second ejector to be both prevented from entering between the web and the applicator roll and the coating liquid is not prevented from making contact with the web. Moreover, the contact ability of the web to the applicator roll is further enhanced, the coating irregularity and the misting are reduced and the coating state of the web is enhanced. Also, by providing the second ejector in place of the blade, the entrained air flow can be blocked with no contact with the web and there is caused no problem of breakage of the web.

(8) According to the eight aspect of the invention, the coating apparatus as mentioned in the seventh aspect of the invention is constructed such that an ejecting direction of a nozzle of the second ejector is in the range of 10° to 45° relative to the surface of the web. Hence, in addition to the function and effect of the seventh aspect of the invention, the ejector gas collides with the entrained air flow caused by the web and the entrained air flow can be further effectively prevented.

(9) According to the ninth aspect of the invention, the coating apparatus as mentioned in the seventh aspect of the invention is constructed such that the boundary air remover comprises a front plate portion closing a space between the first ejector and the second ejector and a top plate portion formed by the portion of the web between a position where the web faces the second ejector and a position where the web makes contact with the applicator roll so that the front plate portion and the top plate portion form a box part between the nip portion and the first and second ejectors on the upstream side of the nip portion in the rotational direction of the applicator roll. The box part has a length larger than a width to be coated of the web and is arranged so as to cover a portion of the surface of the applicator roll along an axial direction of the applicator roll. The front plate portion and the first ejector are provided closely to the applicator roll coated with the coating liquid with a gap being maintained therebetween so as not to make contact with each other and the second ejector is provided closely to the web with a gap being maintained therebetween so as not to make contact with each other. Hence, in addition to the function and effect of the seventh aspect of the invention, the side of the web facing the applicator roll on the upstream side of the nip portion is directed to the interior of the box part, not to the outside, and the entrained air flow is further effectively prevented from entering between the web and the applicator roll. Also, while a negative pressure is caused on the back side of the ejection of the ejector gas from the first and second ejectors, this negative pressure in the box part accelerates the web to make contact with the applicator roll. Further, by providing lower edge portions of the first ejector and the box end plates closely to the applicator roll coated with the coating liquid with a gap being maintained therebetween so as not to make contact with each other, air inflow due to the negative pressure can be reduced and re-generation of the entrained air flow due to the inflow air can be prevented.

(10) According to the tenth aspect of the invention, the coating apparatus as mentioned in any one of the fifth, sixth and ninth aspects is constructed such that the boundary air remover comprises a box end plate provided at each of both end portions of the box part in the axial direction of the applicator roll, the box end plate being provided closely to the applicator roll coated with the coating liquid with a gap being maintained therebetween so as not to make contact with each other. Hence, in addition to the function and effect of the invention of any one of the fifth, sixth and ninth aspects, the box end plate is arranged so as to close the opening at each of both side end portions of the box part and provided closely to the applicator roll coated with the coating liquid with a gap being maintained therebetween so as not to make contact with each other and thereby the air inflow can be further effectively reduced and re-generation of the entrained air flow due to the inflow air can be prevented. Thus, the problem is solved in that, if the side end portions of the box part are kept open and the box part has no sufficient width, the surrounding air flows into the box part from the side end portions thereof to re-generate the entrained air flow to thereby reduce the effect of the ejector for blocking the entrained air flow.

(11) According to the eleventh aspect of the invention, the coating apparatus as mentioned in the tenth aspect of the invention is constructed such that the box end plate is provided movably in the axial direction of the applicator roll. Hence, in addition to the function and effect of the tenth aspect of the invention, if the web has a small width, the box end plate is positioned so as to meet this web width and air inflow into the box part from the side end portions of the web is prevented. If the web itself forms the top plate portion of the box part, especially a high effect can be obtained.

(12) According to the twelfth aspect of the invention, the coating apparatus as mentioned in the tenth aspect of the invention is constructed such that the boundary air remover comprises a vent hole provided on the box part and connected with a suction device so that gas in the box part is sucked out. Hence, in addition to the function and effect of the tenth aspect of the invention, air entering the box part is discharged and re-generation of the entrained air flow caused by the inflow air is effectively prevented. Also, as the negative pressure in the box part is maintained, the contact ability of the web to the applicator roll is enhanced and occurrence of the mist after the web passes through the nip portion is remarkably reduced. If the web itself forms the top plate portion of the box part, especially a high effect can be obtained.

(13) According to the thirteenth aspect of the invention, the coating apparatus as mentioned in the tenth aspect of the invention is constructed such that the boundary air remover comprises a vent hole provided on the box part and connected with a steam supply device so that steam is supplied into the box part. Hence, in addition to the function and effect of the tenth aspect of the invention, the air in the box part is mostly replaced with the steam and the interior of the box part is maintained in a slightly positive pressure to thereby prevent the air inflow. Even if an entrained flow of the steam is caused, the steam is condensed on the boundary layer of the surfaces of the applicator roll and the web to thereby generate a negative pressure there and the contact ability of the web to the applicator roll is enhanced. Also, a wetting ability of the web is enhanced by the condensation of the steam and an applying rate of the coating liquid is increased and a quality of the coating is enhanced. If the web itself forms the top plate portion of the box part, especially a high effect can be obtained.

(14) According to the fourteenth aspect of the invention, a coating apparatus comprising two applicator rolls arranged to abut on each other so as to form a nip portion therebetween and to transfer a coating liquid applied to surfaces of the applicator rolls to be coated on a surface of a web passing through the nip portion is constructed such that an air levitating type turn bar is provided on a downstream side of the nip portion so that the web after passing through the nip portion is wound around the surface of one applicator roll of the two applicator rolls to be transferred. In addition, a paper roll is provided on an upstream side of the nip portion in a running direction of the web so that the web before entering the nip portion is wound around the surface of the other applicator roll of the two applicator rolls to be transferred. Further, a boundary air remover is provided between the web and the other applicator roll on an upstream side of a position where the web makes contact with the surface of the other applicator roll so as to prevent air from entering the nip portion. Hence, in the coating apparatus comprising the two applicator rolls arranged to abut on each other so as to form the nip portion therebetween and to transfer the coating liquid applied to the surfaces of the applicator rolls to be coated on the surface of the web passing through the nip portion, the boundary air remover prevents air from entering the nip portion. Thereby, in the portion of the web wound around the applicator roll on the upstream side of the nip portion, the coating liquid is not prevented from making contact with the web, the contact ability of the web to the applicator roll is enhanced, the coating irregularity and the misting are reduced and the coating state of the web is enhanced. Also, the coating state on the upstream side of the nip portion and that on the downstream side of the nip portion can be easily equalized to each other and the coating state of both sides of the web is also equalized so that the quality of the coating can be enhanced.

DETAILED DESCRIPTION OF THE PREFERRED EMBODIMENTS

Herebelow, the present invention will be described more concretely based on first to third embodiments as the best embodiments to practice the present invention.

First Embodiment

Figure 1:
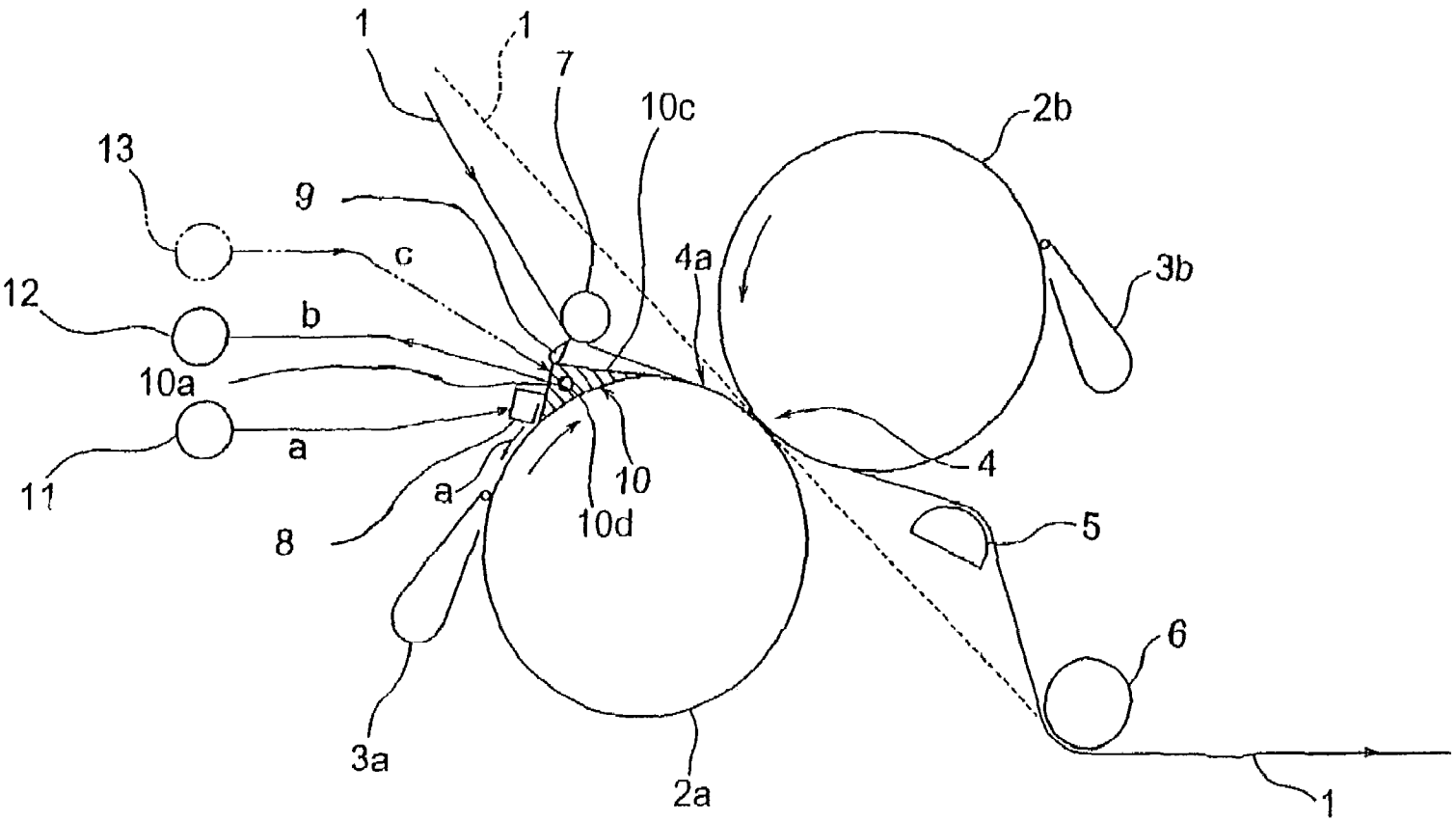
FIG. 1 is a schematic side view of a coating apparatus of a first embodiment according to the present invention.
Figure 2:
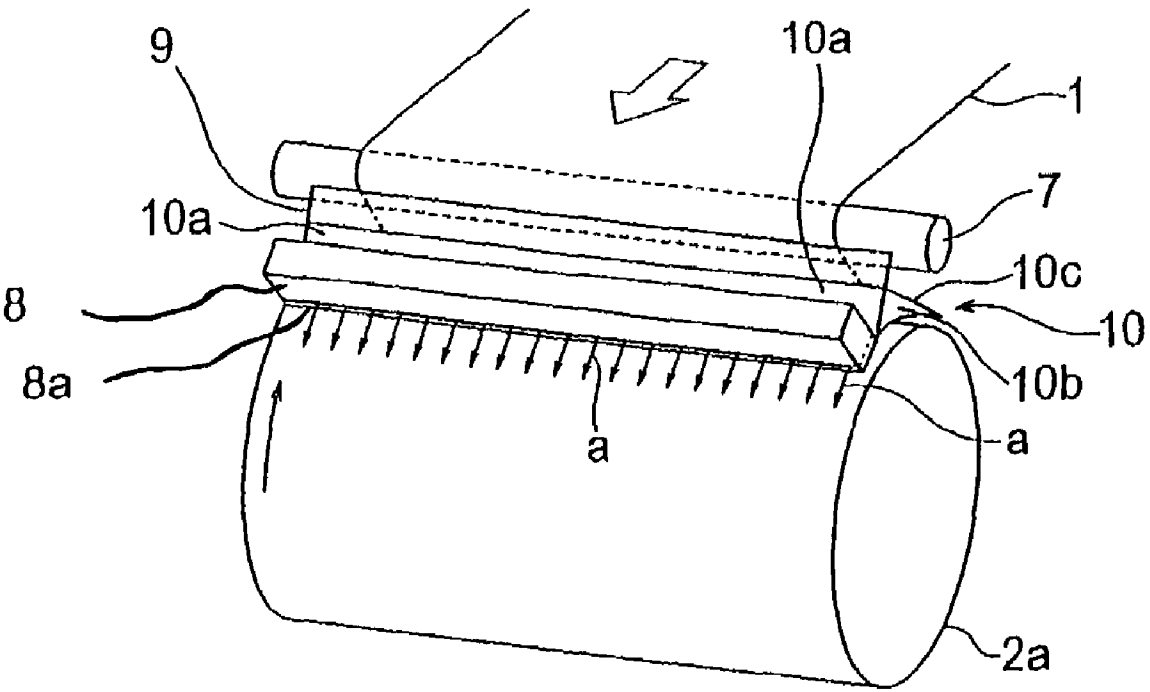
FIG. 2 is a perspective view showing an arrangement of a box part and an ejector of the first embodiment.
Figure 3:
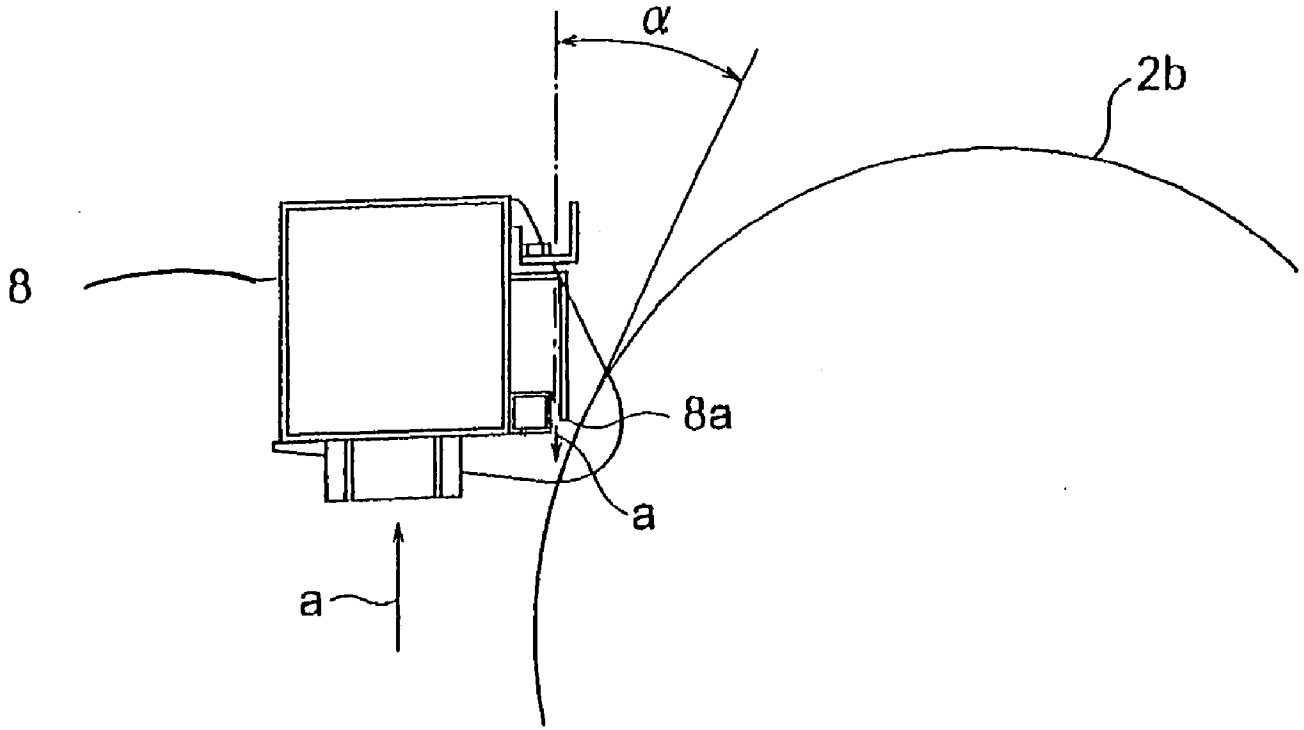
FIG. 3 is a cross sectional view of the ejector of FIG. 2 and the surroundings thereof.
Figure 4:
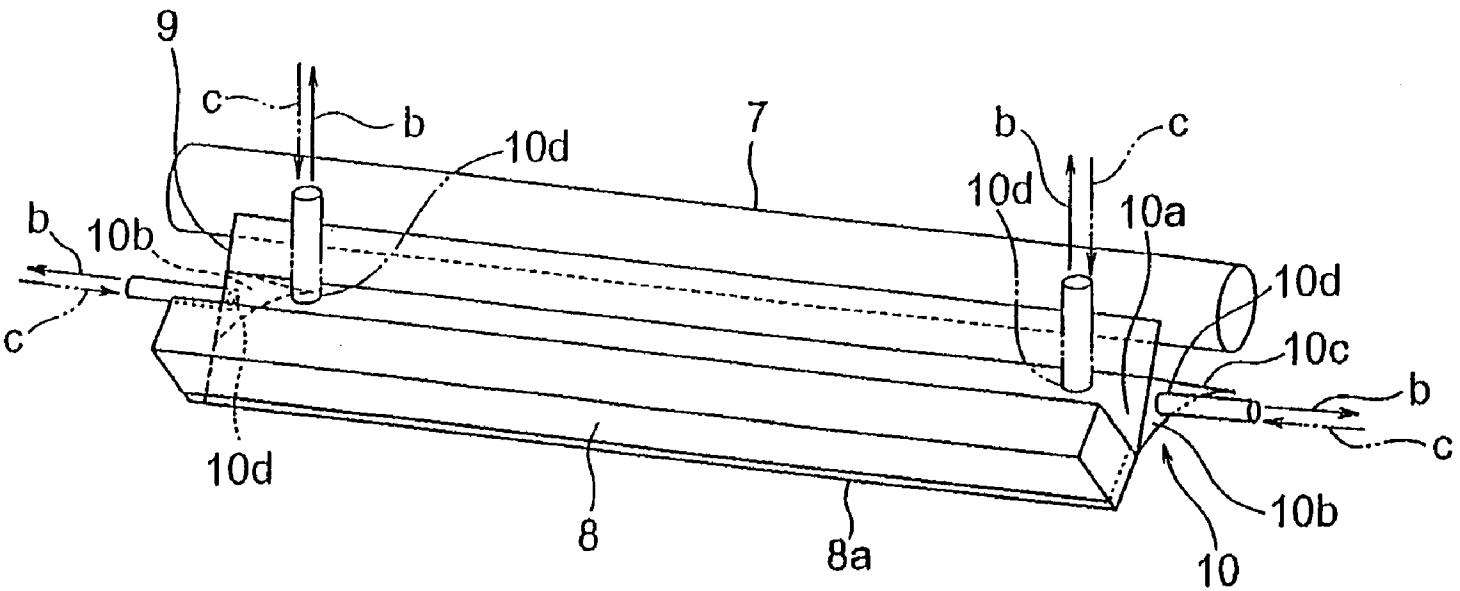
FIG. 4 is a detailed perspective view of the box part and the ejector of the first embodiment.
Figure 9:
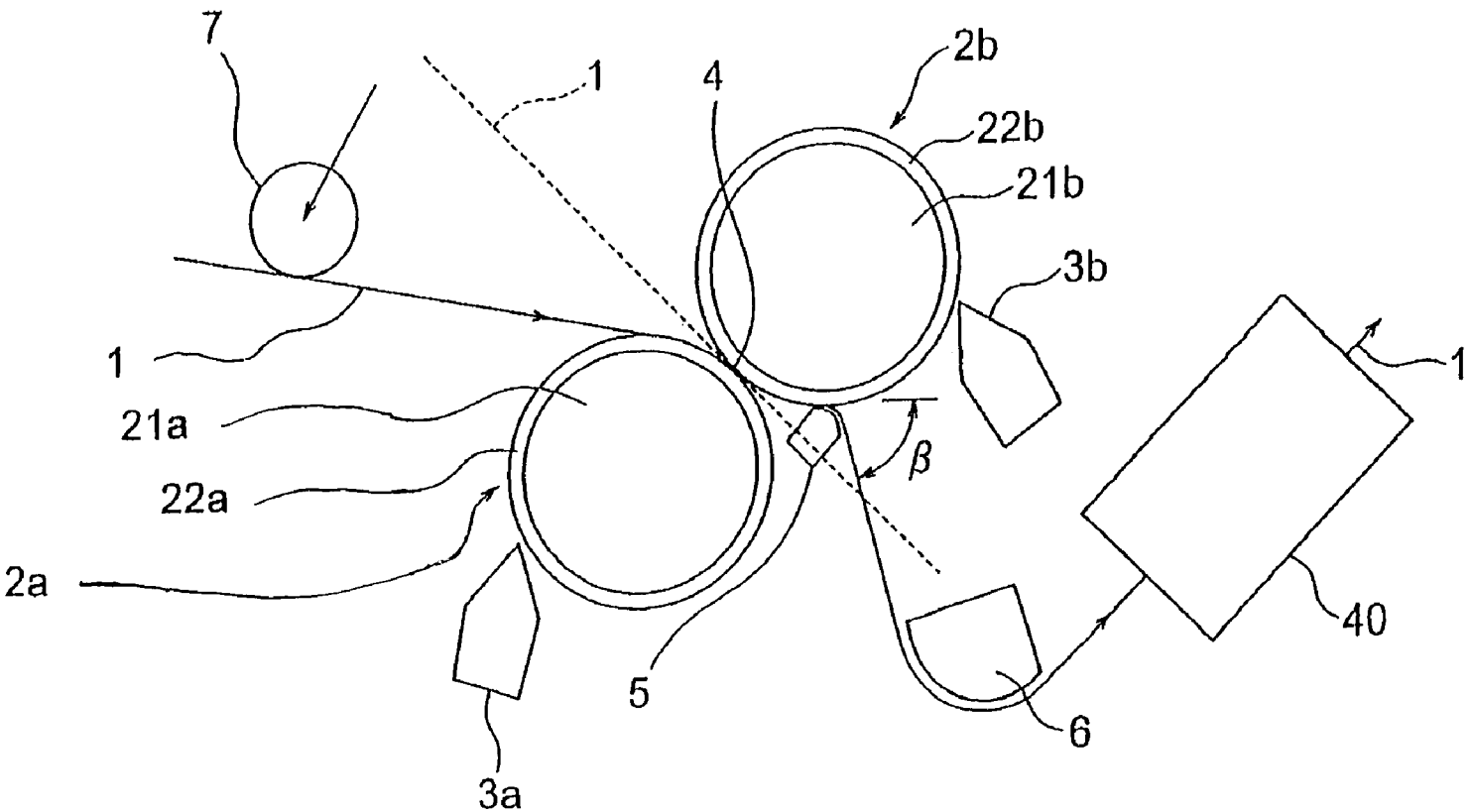
Fig. 9 (Prior Art)
FIG. 9 is a schematic side view of a prior art example of a coating apparatus.

A coating apparatus of the first embodiment according to the present invention will be described with reference to FIGS. 1 to 4. FIG. 1 is a schematic side view of the coating apparatus of the present embodiment, FIG. 2 is a perspective view showing an arrangement of a box part and an ejector of the present embodiment, FIG. 3 is a cross sectional view of the ejector and the surroundings thereof and FIG. 4 is a detailed perspective view of the box part and the ejector. The present embodiment is basically the same as the conventional device shown in FIG. 9 except that the portion on the upstream side of the nip portion 4 is differently constructed. Thus, the parts and components same as those of the apparatus of FIG. 9 are given with the same reference numerals with description thereof being omitted or simplified and the points different from the conventional example of FIG. 9 will be mainly described next.

In FIG. 1, a lower applicator roll 2*a* (sometimes referred to as "one applicator roll" in the present invention, which also applies to the subsequent embodiments), and an upper applicator roll 2*b* (sometimes referred to as "another applicator roll" in the present invention, which also applies to the subsequent embodiments), are opposedly provided so as to abut on each other and to form a nip portion 4 therebetween. A web 1 of paper or the like transferred from a previous process passes through the nip portion 4 to thereby be coated with a coating liquid and then, via a turn bar (an air levitating type non-contact turn bar) 6 that transfers the web 1 while the web 1 is being levitated by air, enters a drying device 40 (FIG. 9). The applicator rolls 2*a*, 2*b* comprise roll bodies 21*a*, 21*b*, respectively, made of a metal such as steel or the like and elastic sheets 22*a*, 22*b*, respectively, of rubber or the like applied to outer circumferential surfaces of the roll bodies 21*a*, 21*b* and rotate with a circumferential velocity the same as a running velocity of the web 1. On the upstream side of the nip portion 4 in respective rotational directions of the applicator rolls 2*a*, 2*b*, a lower coater head 3*a* and an upper coater head 3*b*, respectively, are provided as devices for supplying the coating liquid onto the outer surfaces of the respective elastic sheets 22*a*, 22*b*.

The respective coater heads 3*a*, 3*b* as coating liquid supply devices form coating liquid films of a predetermined film thickness on the surfaces of the applicator rolls 2*a*, 2*b* and the coating liquid films formed on the surfaces of the applicator rolls 2*a*, 2*b* make contact with surfaces of respective sides of the web 1 and are transferred to be coated thereon. The web 1 coated with the coating liquid is transferred into the drying device 40 via the turn bar 6.

Also, a roll side turn bar 5 of an air levitating type (sometimes referred to as an "air levitating type turn bar" in the present invention) is provided between the nip portion 4 and the turn bar 6 so that the web 1 after passing through the nip portion 4 is urged toward the surface of the upper applicator roll 2*b* from a tangential direction of the nip portion 4 shown by a dotted line in FIG. 1 to thereby be transferred being kept supported on the surface of the upper applicator roll 2*b*.

Further, a paper roll 7 is provided on the upstream side of the nip portion 4 in the running direction of the web 1 so that the web 1 before entering the nip portion 4 is urged toward the surface of the lower applicator roll 2*a* on the opposite side of the upper applicator roll 2*b* to thereby be transferred being kept supported on the surface of the lower applicator roll 2*a*. So far, the description is the same as in FIG. 9.

In the present embodiment, as shown in FIGS. 1 and 2, an ejector 8 is provided between the nip portion 4 and a lower coater head 3*a* on the upstream side of the nip portion 4 in the rotational direction of the lower applicator roll 2*a* so as to extend along a substantially entire width of the lower applicator roll 2*a* or so as to cover at least a width to be coated of the web 1. The ejector 8 ejects an ejector gas a onto the surface of the lower applicator roll 2*a* toward the upstream direction in the rotational direction of the lower applicator roll 2*a* and functions as a boundary air remover of the present invention.

As shown in FIGS. 2 and 3, the ejector 8 is formed by a closed cylindrical hollow body provided with a nozzle 8*a* directed toward the upstream direction in the rotational direction of the lower applicator roll 2*a*. While an ejecting angle $\alpha$ of the ejecting direction of the nozzle 8*a* is set according to the kind of the coating liquid, the rotating velocity of the lower applicator roll 2*a*, etc., it is preferable to be approximately in the range of 10° to 45° relative to the tangential direction of the lower applicator roll 2*a* at the position where the ejector gas a is blown against the surface of the lower applicator roll 2*a*. By the ejector gas a colliding with the entrained air flow of the lower applicator roll 2*a* in this angular range, little ejector gas a is jumped up or pushed back by the entrained air flow and the entrained air flow can be effectively prevented. The nozzle 8*a* is formed in a slit shape, a multi-holes row shape, etc.

The ejector gas a is supplied into the cylindrical hollow body of the ejector 8 from an ejector gas supply device 11 of an arbitrary type, as shown in FIG. 1. As the ejector gas a, air can be generally used but steam, inert gas or the like of nitrogen, etc. can also be used according to the conditions. An ejecting velocity of the ejector gas a can be appropriately set according to the circumstances but, in order to block the entrained air flow caused by the rotation of the lower applicator roll 2*a*, is preferably set to such a reverse velocity as is approximately equivalent to the rotational circumferential velocity of the lower applicator roll 2*a* (that is, the web running velocity) or higher than that. However, if the ejecting velocity is set excessively higher, it is not preferable as the state of the coating liquid applied to the circumferential surface of the lower applicator roll 2*a* is deteriorated.

Also, in order to block the entrained air flow on the web 1 side, a blade 9 is provided on the upstream side of the nip portion 4 in the running direction of the web 1 so as to extend in the web width direction making contact with the surface of a side of the web 1 on the lower applicator roll 2*a* side.

As shown in FIGS. 1 and 2, a box part 10 is provided between the nip portion 4 and the lower coater head 3*a* on the upstream side of the nip portion 4 in the rotational direction of the lower applicator roll 2*a* so as to cover a portion of the circumferential surface of the lower applicator roll 2*a*. The box part 10 forms a boundary air remover of the present invention and comprises a box front plate 10*a* on the upstream side in the rotational direction of the lower applicator roll 2*a* and a box top plate 10*c* on the downstream side in the same direction, wherein the box front plate 10*a* and the box top plate 10*c* are jointed together so as to form a cross sectional mountain shape extending along the circumferential surface of the lower applicator roll 2*a*.

The box part 10 has a length to cover approximately an entire width of the lower applicator roll 2*a* or at least a width to be coated of the web 1. The blade 9 has a length to cover approximately an entire length of the box part 10 or at least the width to be coated of the web 1 and has its length-wise one side edge portion fitted to the box part 10 in the vicinity of the portion where the box front plate 10*a* and the box top plate 10*c* are jointed together. The blade 9 forms one element of the boundary air remover of the present invention.

The blade 9 has the other length-wise side edge portion arranged to abut on the web 1 along the web width direction at the position where the web 1 is wound around the paper roll 7. The ejector 8 is fitted to the box front plate 10. The ejector 8 may be either integrally formed with the box front plate 10*a* or separately formed from the box front plate 10*a* to then be fitted thereto. Also, while the box front plate 10*a* and the blade 9 have been described as those constructed separately from each other, they may be integrally formed as one member and the same function can be obtained by the simple structure. But by forming them separately from each other, an advantage is obtained in that the blade, if worn, can be easily exchanged. Also, the box part 10 may be constructed such that the ejector 8 and the blade 9 are integrally formed to thereby substantially form the box front plate 10*a* at the same time.

In the construction of the coating apparatus as described above, the portion between the ejector 8 on the lower applicator roll 2*a* side and the blade 9 on the web 1 side is closed by the box front plate 10*a* and the box part 10 is provided comprising the box front plate 10*a*, the blade 9 and the box top plate 10*c* and thereby the entrained air flow can be prevented from entering the nip portion 4.

Nevertheless, as it is preferable that less air enters the box part 10, the box part 10 has each of its length-wise end portions or each of its end portions in the axial direction of the lower applicator roll 2*a* provided with a box end plate 10*b* so that an opening of the cross sectional mountain shape formed by the ends of the box top plate 10*c* and the box front plate 10*b* is closed. This construction is especially effective if the length of the box part 10 is not sufficiently ensured. The lower edge portion of the box top plate 10*c* on the lower applicator roll 2*a* side is arranged being elongated toward the web downstream direction (or toward a point 4*a* where the web 1 and the lower applicator roll 2*a* make contact with each other) so as not to make contact with the web 1 on the upstream side of the nip portion 4. Also, the respective lower edge portions of the box front plate 10*a* (or the ejector 8), the box end plates 10*b* and the box top plate 10*c* are arranged closely to the circumferential surface of the lower applicator roll 2*a* coated with the coating liquid with a gap being formed therebetween so as not to directly make contact with each other.

As shown in FIGS. 1 and 4, a vent hole 10*d* is preferably provided in the box part 10 and a vent pipe is at its one end connected to the vent hole 10*d* and at the other end connected with a suction device 12 so that gas b (usually air) in the box part 10 is sucked out. Or the vent pipe at the other end is connected with a steam supply device 13 so that steam c is supplied into the box part 10. The vent hole 10*d* may be provided at an appropriate position, not necessarily at a limited position, of the box end plate 10*b*, the box front plate 10, etc. but, most effectively, the vent hole 10*d* as a discharge place of inflow air is provided in the box end plates 10*b* at both side ends of the box part 10 so that air or gas most smoothly flows in or flows out.

In the coating apparatus of the present embodiment constructed as mentioned above, the entrained air flow caused by the rotation of the lower applicator roll 2*a* is blocked by the ejector gas a ejected from the nozzle 8*a* of the ejector 8 so as to be prevented from entering between the web 1 and the lower applicator roll 2*a*. Also, the entrained air flow caused by the running of the web 1 is blocked by the blade 9 so as to be prevented from entering between the web 1 and the lower applicator roll 2*a*.

On the other hand, as a negative pressure is caused on the back side of the ejector gas a ejected from the ejector 8, if the box part 10 is open toward the surroundings thereof (especially at the length-wise end portions of the box part 10), the surrounding air will easily flow into the box part 10 so as to re-generate the entrained air flow and this will invite a problem to reduce the effect of blocking the entrained air flow by the ejector 8. Especially, if the length of the box part 10 is not sufficiently ensured, this problem becomes large.

Hence, the box end plate 10*b* is provided on each of the length-wise end portions of the box part 10 so as to close the opening of the cross sectional mountain shape and the respective lower edge portions of the box front plate 10*a* (or the ejector 8), the box end plates 10*b* and the box top plate 10*c* are arranged closely to the circumferential surface of the lower applicator roll 2*a* coated with the coating liquid with a gap being formed therebetween so as not to make contact with each other. Thereby, inflow of the air into the box part 10 can be reduced and the re-generation of the entrained air flow caused by the air inflow can be prevented.

It is to be noted that if the box end plate 10*b* is made movable in the axial direction of the lower applicator roll 2*a* so as to be positioned to meet the width of the web 1, it will be more preferable for preventing the inflow of the air. Also, if a portion of the box part 10 is constructed by the web 1 itself, like in the second and third embodiments to be described later, and if the web 1 is thin or a density of the web 1 is small, air easily passes through the web surface and a problem of reducing the effect of providing the box part 10 will arise. But in the present first embodiment, the box part 10 is constructed by no portion of the web 1 itself and there no such problem is caused.

Also, as mentioned above, the construction is made such that the vent hole 10*d* is provided in the box part 10 so that one end of the vent pipe is connected to the vent hole 10*d* and the other end of the vent pipe is connected with the suction device 12 to thereby suck out the gas b (usually air) in the box part 10. Thus, the air entering the box part 10 is discharged outside and the re-generation of the entrained air flow caused by the inflow of the air can be more effectively prevented. Also, as the interior of the box part 10 can be maintained in a negative pressure, the contact ability of the web 1 to the lower applicator roll 2*a* in the vicinity of the lower edge portion of the box top plate 10*c* is enhanced. As the result thereof, the mist generation on the downstream side of the nip portion 4 is remarkably reduced. For example, as the result of tests, while the mist generation in the case where none of the ejection by the ejector 8 and the suction of the gas in the box part 10 is carried out is about 0.045 $g/m^2/sec$, the mist generation in the case where both of the ejection by the ejector 8 and the suction of the gas in the box part 10 are carried out is reduced to about 0.003 to 0.009 $g/m^2/sec$, that is, about one tenth of the former.

Or, one end of the vent pipe is connected to the vent hole 10*d* and the other end of the vent pipe is connected to the steam supply device 13 to thereby supply steam c into the box part 10. Thus, the air in the box part 10 is mostly replaced with the steam c and the interior of the box part 10 is maintained in a slightly positive pressure so that the inflow of the air is prevented. Also, even if an entrained flow of the steam is caused, the steam is condensed on the boundary layer of the surfaces of the lower applicator roll 2*a* and the web 1 to thereby generate a negative pressure there, so that the contact ability of the web 1 to the lower applicator roll 2*a* is enhanced.

Also, the wetting ability of the web 1 is enhanced by the condensation of the steam (that is, an air layer on the web surface or air in the web pores are replaced with condensed water), so that the applying rate of the coating liquid is increased and the quality of the coating is enhanced.

As the ejector gas a of the ejector 8, air can be generally used but if steam is used, as there are usually plenty of steam sources in paper working plants, etc., a high usability of existing facilities is obtained. Moreover, such an effect is obtained that the coating liquid on the lower applicator roll 2*a* is prevented from becoming dried and the contact ability of the web 1 is enhanced by wetting of the steam. Also, if the coating liquid is a special one, an inert gas can be used for the ejector gas a so that an unusual reaction is prevented.

According to the present first embodiment, not only the entrained air flow of the web 1 but also the entrained air flow of the lower applicator roll 2*a* can be removed. Thereby, the web 1 is not prevented from making contact with the coating liquid, the contact ability of the web 1 to the lower applicator roll 2*a* is enhanced, the coating irregularity and the misting are reduced and the coating state of the web 1 is enhanced.

Also, by the coating state on the upstream side of the nip portion 4 being so improved, the coating state on the upstream side of the nip portion 4 and that on the downstream side of the nip portion 4 can be easily equalized with each other and a uniform coating state of high quality can be realized on both sides of the web 1.

Second Embodiment

Figure 5:
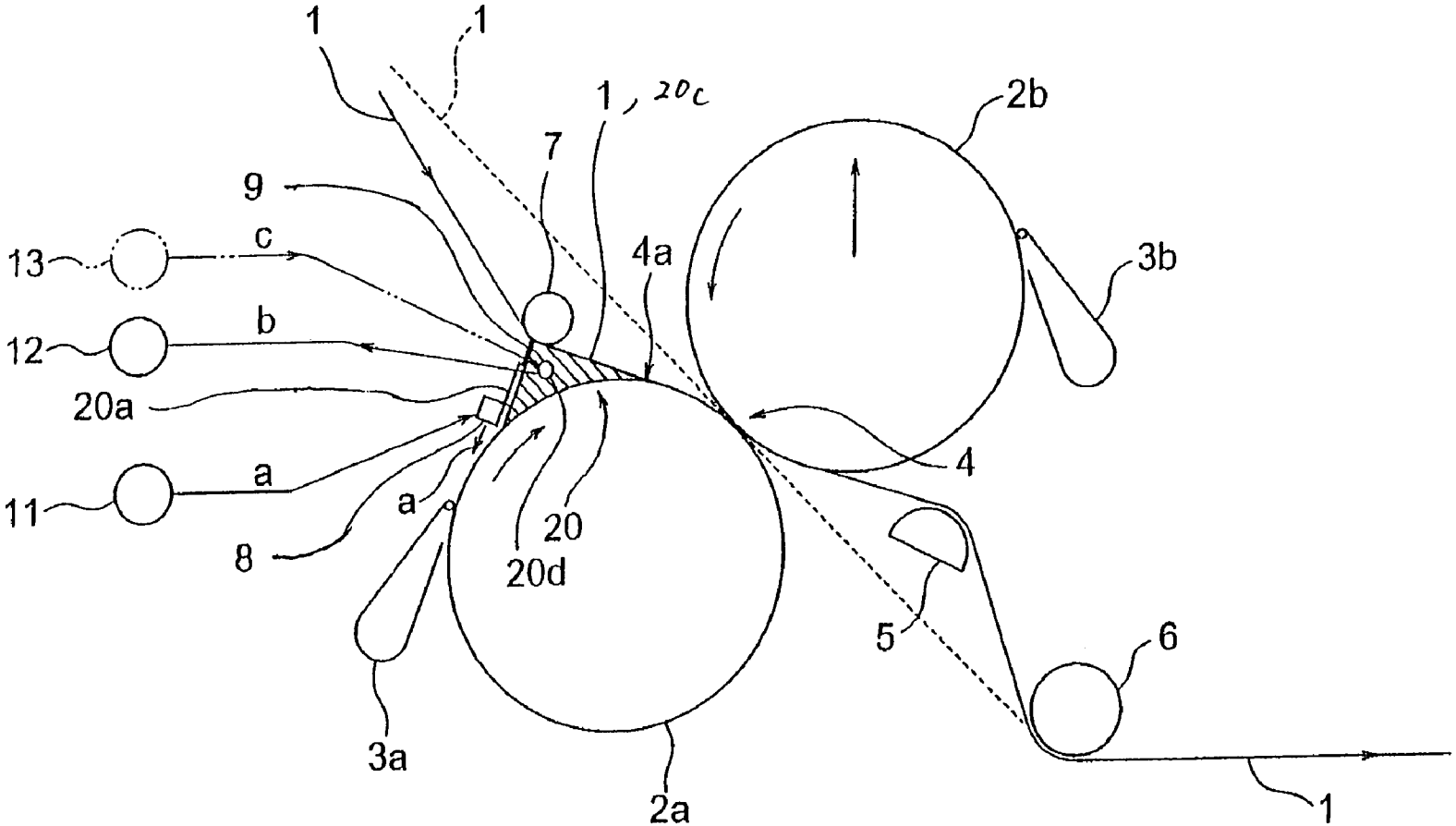
FIG. 5 is a schematic side view of a coating apparatus of a second embodiment according to the present invention.
Figure 6:
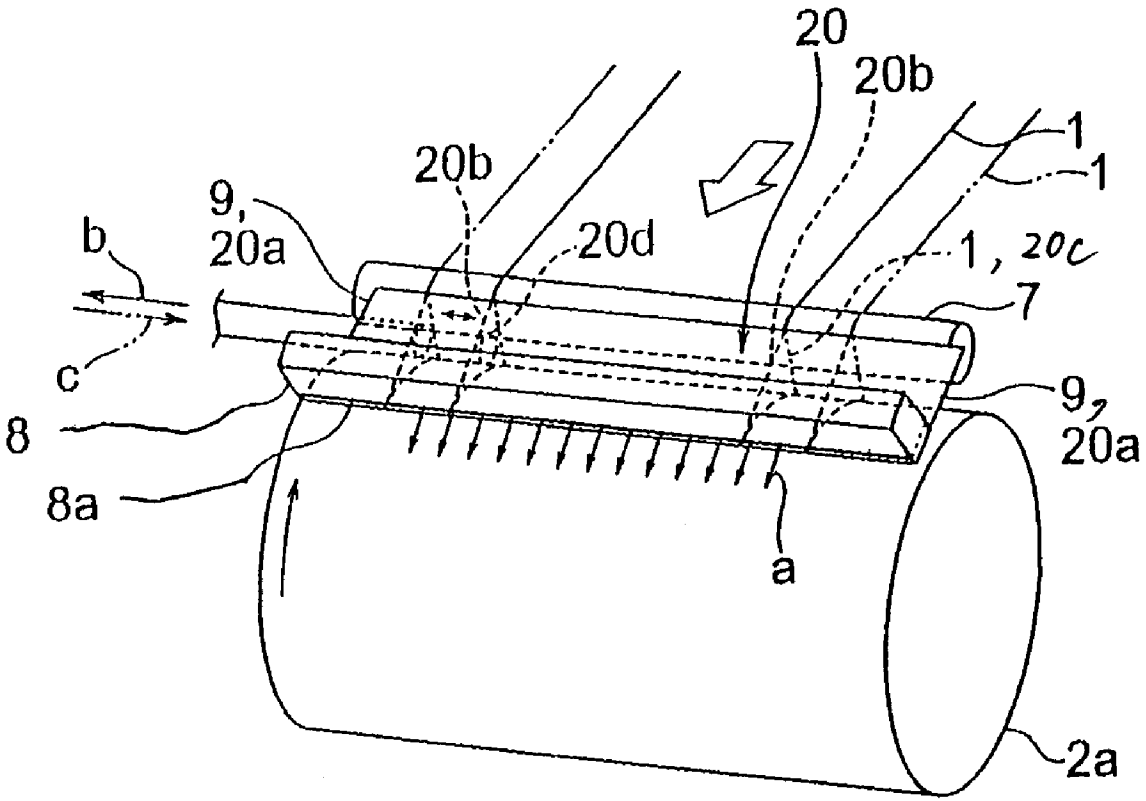
FIG. 6 is a perspective view showing an arrangement of a box part and an ejector of the second embodiment.

A coating apparatus of a second embodiment according to the present invention will be described based on FIGS. 5 and 6. FIG. 5 is a schematic side view of the coating apparatus of the present embodiment and FIG. 6 is a perspective view showing an arrangement of a box part and an ejector of the present embodiment. In the present embodiment, the construction is substantially the same as that of the first embodiment except for the construction of the box part. Hence, the parts and components which are the same as those of the first embodiment are designated with the same reference numerals with the description thereof being omitted and the points different from the first embodiment will be mainly described. The ejector itself is the same as that of the first embodiment shown in FIGS. 2 and 3 and a description thereof will be omitted.

In the present embodiment, as shown in FIGS. 5 and 6, the ejector 8 is provided between the nip portion 4 and the lower coater head 3*a* on the upstream side of the nip portion 4 in the rotational direction of the lower applicator roll 2*a* so as to extend substantially along the entire width of the lower applicator roll 2*a* or so as to cover at least the web 1 to be coated. The ejector 8 is a boundary air remover of the present invention and functions to eject the ejector gas a onto the surface of the lower applicator roll 2*a* toward the upstream direction of the rotational direction of the lower applicator roll 2*a* in order to block the entrained air flow caused by the rotation of the lower applicator roll 2*a*.

Also, in order to block the entrained air flow on the web 1 side, a blade 9 is provided on the upstream side of the nip portion 4 in the running direction of the web 1 so as to extend in the web width direction making contact with the surface of the side of the web 1 on the lower applicator roll 2*a* side.

As shown in FIGS. 5 and 6, a box part 20 is formed between the nip portion 4 and the lower coater head 3*a* on the upstream side of the nip portion 4 in the rotational direction of the lower applicator roll 2*a* so as to cover a portion of the circumferential surface of the lower applicator roll 2*a*. The box part 20 forms a boundary air remover of the present invention and comprises an upstream side wall formed by a box front plate 20*a* and the blade 9 fitted to an upper end portion of the box front plate 20*a* and a downstream side wall as a top plate portion 20*c* formed by the portion of the web 1 between the position where the web 1 makes contact with the blade 9 and a position 4*a* where the web 1 makes contact with the lower applicator roll 2*a*, in place of the box top plate 10*c* of the first embodiment, wherein the upstream side wall and the downstream side wall are arranged to abut on each other so as to form a cross sectional mountain shape elongating along the circumferential surface of the lower applicator roll 2*a*.

The box front plate 20*a* has a length to cover approximately the entire width of the lower applicator roll 2*a* or at least the width to be coated of the web 1. The blade 9 has a length to cover approximately an entire length of the box front plate 20*a* and has its length-wise one side edge portion fitted to an upper side edge portion in FIG. 5 of the box front plate 20*a* and the other length-wise side edge portion arranged to abut on the web 1 along the web width direction at the position where the web 1 is wound around the paper roll 7. The ejector 8 is fitted to the box front plate 20*a*. The ejector 8 may be either integrally formed with the box front plate 20*a* or separately formed from the box front plate 20*a* to then be fitted thereto. Also, like in the first embodiment, the box front plate 20*a* and the blade 9 may be integrally formed as one member or separately formed from each other. Likewise, the ejector 8 and the blade 9 may be integrally formed to thereby substantially form the box front plate 20*a*.

In the construction of the coating apparatus described above, a space between the ejector 8 on the lower applicator roll 2*a* side and the blade 9 on the web 1 side is closed by the box front plate 20*a* and the box part 20 is provided comprising the box front plate 20*a*, the blade 9 and the top plate portion 20*c* and thereby the entrained air flow can be prevented from entering the nip portion 4.

Nevertheless, as it is preferable that less air enters the box part 20, the box part 20 has each of its length-wise both end portions at both side end portions of the top plate portion 20*c* formed by the web 1 provided with a box end plate 20*b* so that the opening of the cross sectional mountain shape is closed. This construction is especially effective if the length of the box part 20 is not sufficiently ensured. Also, the respective lower edge portions of the box front plate 20*a* (or the ejector 8) and the box end plates 20*b* are preferably arranged closely to the circumferential surface of the lower applicator roll 2*a* coated with the coating liquid with a gap being formed therebetween so as not to directly make contact with each other.

The box end plates 20*b* are preferably movable in the axial direction (width direction) of the lower applicator roll 2*a* so as to be positionable to meet the width of the top plate portion 20*c* formed by the web 1. In this case, no opening is formed at the end portions of the top plate portion 20*c* in the web width direction and the air can be more effectively prevented from entering the box part 20.

Also, the construction is preferably made such that a vent hole 20*d* is provided in the box part 20 so that one end of a vent pipe is connected to the vent hole 20*d* and the other end of the vent pipe is connected with a suction device 12, as shown in FIG. 5, to thereby suck out the gas b in the box part 20 or the other end of the vent pipe is connected with a steam supply device 13, as shown also in FIG. 5, to thereby supply steam into the box part 20. The vent hole 20*d* may be provided at an appropriate position, not necessarily at a limited position, of the box end plates 20*b* or the box front plate 20*a* but, most effectively, the vent hole 20*d* as a discharge place of inflow air is provided in the box end plates 20*b* at both side ends of the box part 20 so that air or gas most smoothly flows in or flows out.

In the coating apparatus of the present embodiment constructed as mentioned above, the entrained air flow caused by the rotation of the lower applicator roll 2*a* is blocked by the ejector gas a ejected from the nozzle 8*a* of the ejector 8 and the entrained air flow caused by the running of the web 1 is blocked by the blade 9. Moreover, the side of the web 1 facing the lower applicator roll 2*a* on the upstream side of the nip portion 4 is directed to the interior of the box part 20, not to the outside. Hence, the entrained air flow is further effectively prevented from entering between the web 1 and the lower applicator roll 2*a*.

However, a negative pressure is caused on the back side of the ejector gas a ejected from the ejector 8 and this negative pressure in the box part 20 functions to accelerate the web 1 to make contact with the lower applicator roll 2*a*. If the box part 10 is open toward the surroundings thereof, the surrounding air will easily flow into the box part 10 so as to re-generate the entrained air flow and this will invite a problem to reduce the effect of blocking the entrained air flow by the ejector 8.

Hence, like in the first embodiment, the box end plate 20*b* is provided on each of the length-wise end portions of the box part 20 so as to close the opening of the cross sectional mountain shape and the respective lower edge portions of the box front plate 20*a* (or the ejector 8) and the box end plates 20*b* are arranged closely to the circumferential surface of the lower applicator roll 2*a* coated with the coating liquid with a gap being formed therebetween so as not to make contact with each other. Thereby, inflow of the air into the box part 20 can be reduced and the re-generation of the entrained air flow caused by the air inflow can be prevented.

Here, like in the first embodiment, the construction is made such that the vent hole 20*d* is provided in the box part 20 so that one end of the vent pipe is connected to the vent hole 20*d* and the other end of the vent pipe is connected with the suction device 12 to thereby suck out the gas b (usually air) in the box part 20. Thus, the air entering the box part 20 is discharged outside and the re-generation of the entrained air flow caused by the inflow of the air can be more effectively prevented. Also, as the interior of the box part 20 can be maintained in a negative pressure, the top plate portion 20*c* formed by the web 1 is urged toward the lower applicator roll 2*a* and the contact ability of the web 1 to the lower applicator roll 2*a* is enhanced.

Or, one end of the vent pipe is connected to the vent hole 20*d* and the other end of the vent pipe is connected to the steam supply device 13 to thereby supply steam c into the box part 20. Thus, the air in the box part 20 is mostly replaced with the steam c and the interior of the box part 20 is maintained in a slightly positive pressure so that the inflow of the air is prevented. Also, even if an entrained flow of the steam is caused, the steam is condensed on the boundary layer of the surfaces of the lower applicator roll 2*a* and the web 1 to thereby generate a negative pressure there, so that the contact ability of the web 1 to the lower applicator roll 2*a* is enhanced. Also, the wetting ability of the web 1 is enhanced by the condensation of the steam, so that the applying rate of the coating liquid is increased and the quality of the coating is enhanced.

As the ejector gas a of the ejector 8, air can be generally used but if steam or inert gas is used, the same function and effect as described in the first embodiment can be obtained.

According to the present second embodiment, not only the entrained air flow of the web 1 but also the entrained air flow of the lower applicator roll 2*a* can be removed. Thereby, the web 1 is not prevented from making contact with the coating liquid, the contact ability of the web 1 to the lower applicator roll 2*a* is enhanced, the coating irregularity and the misting are reduced and the coating state of the web 1 is enhanced.

Also, by the coating state on the upstream side of the nip portion 4 being so improved, the coating state on the upstream side of the nip portion 4 and that on the downstream side of the nip portion 4 can be easily equalized with each other and a uniform coating state of high quality can be realized on both sides of the web 1.

Third Embodiment

Figure 7:
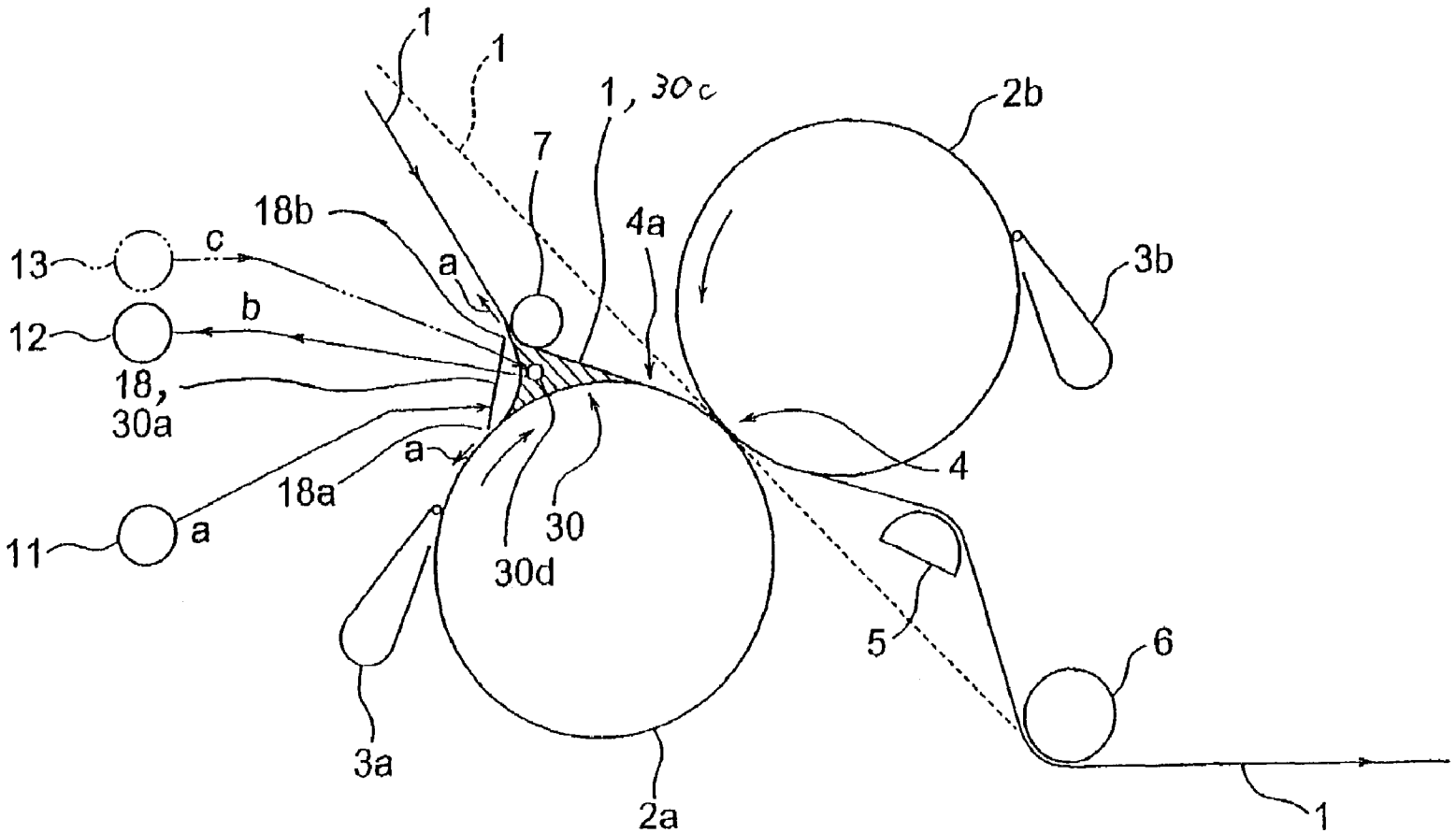
FIG. 7 is a schematic side view of a coating apparatus of a third embodiment according to the present invention.
Figure 8:
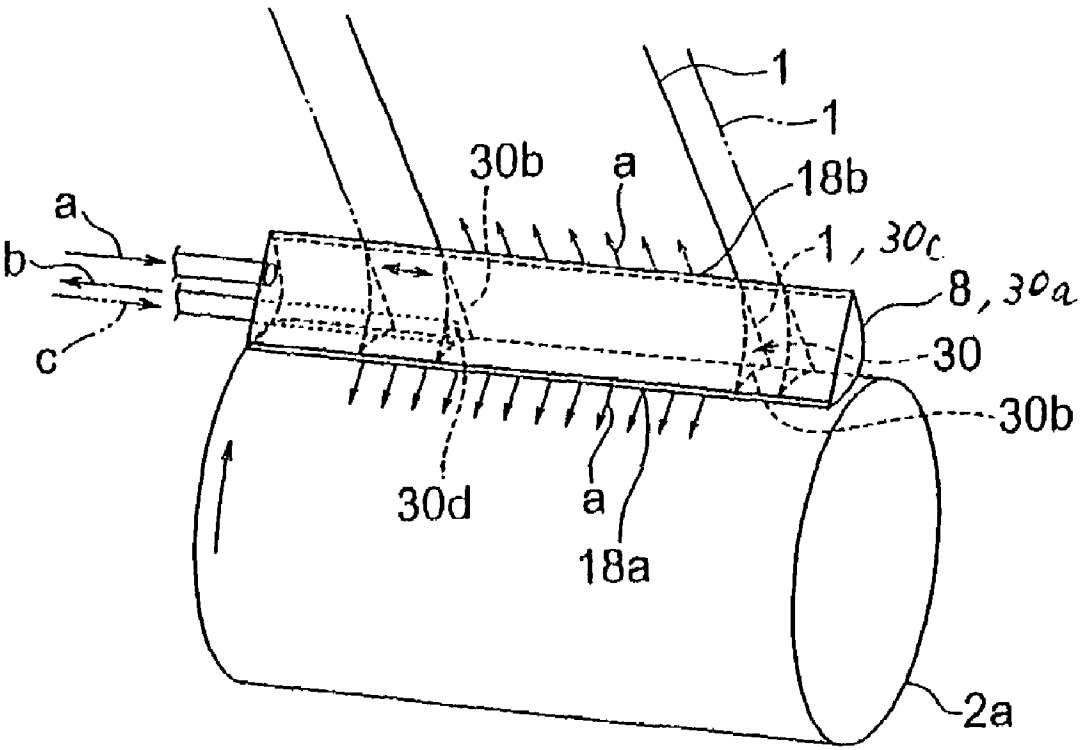
FIG. 8 is a perspective view showing an arrangement of a box part and an ejector of the third embodiment.

A coating apparatus of a third embodiment according to the present invention will be described based on FIGS. 7 and 8. FIG. 7 is a schematic side view of the coating apparatus of the present embodiment and FIG. 8 is a perspective view showing an arrangement of a box part and an ejector of the present embodiment. In the present embodiment, the construction is substantially the same as that of the first embodiment except for the construction of the box part. Hence, the parts and components which are the same as those of the first embodiment are designated with the same reference numerals with the description thereof being omitted and the points different from the first embodiment will be mainly described.

In the present embodiment, as shown in FIGS. 7 and 8, the ejector 18 is provided between the nip portion 4 and the lower coater head 3*a* on the upstream side of the nip portion 4 in the rotational direction of the lower applicator roll 2*a* so as to elongate substantially in the entire width of the lower applicator roll 2*a* or so as to cover at least the web 1 to be coated. The ejector 18 is a boundary air remover of the present invention and comprises a nozzle 18*a* as a first ejector that functions to eject the ejector gas a onto the surface of the lower applicator roll 2*a* toward the upstream direction of the rotational direction of the lower applicator roll 2*a* in order to block the entrained air flow caused by the rotation of the lower applicator roll 2*a*.

Also, the ejector 18 comprises a nozzle 18*b* as a second ejector that functions to eject the ejector gas a onto the surface of the side of the web 1 on the lower applicator roll 2*a* side on the upstream side of the nip portion 4 in the running direction of the web 1 in order to block the entrained air flow caused by the running of the web 1. The ejector 18 further comprises a front plate portion 30*a* that connects the nozzle 18*a* and the nozzle 18*b* together and closes the space between the nozzle 18*a* and the nozzle 18*b*. It is preferable that the nozzle 18*b* ejects the ejector gas a in the vicinity of the paper roll 7 so that the stability of the running web 1 is maintained.

As shown in FIGS. 7 and 8, the ejector 18 is formed by a closed cylindrical hollow body provided with the above-mentioned nozzles 18*a* and 18*b*. While the ejecting direction of the nozzles 18*a* and 18*b* is set according to the kind of the coating liquid, the running velocity of the web 1, the rotating velocity of the lower applicator roll 2*a*, etc., it is preferable that the ejecting direction of the nozzle 18*a* is approximately in the range of 10° to 45° relative to the tangential direction of the lower applicator roll 2*a* at the position of the ejection and the ejecting direction of the nozzle 18*b* is approximately in the range of 10° to 45° relative to the surface of the web 1 at the position of the ejection or, if the surface of the web 1 is round because of the roll, relative to the tangential direction of the roll. The nozzles 18*a* and 18*b* are formed in a slit shape, a multi-holes row shape, etc. The function and effect of the range of the ejecting direction are the same as described with respect to the first embodiment.

The ejector gas a is supplied into the cylindrical hollow body of the ejector 18 from an ejector gas supply device 11 of an arbitrary type, as shown in FIG. 7. As for the ejector gas a and the velocity thereof, the same description as in the first embodiment applies.

Also, as shown in FIGS. 7 and 8, a box part 30 is formed between the nip portion 4 and the lower coater head 3*a* on the upstream side of the nip portion 4 in the rotational direction of the lower applicator roll 2*a* so as to cover a portion of the circumferential surface of the lower applicator roll 2*a*. The box part 30 forms a boundary air remover of the present invention and comprises an upstream side wall formed by the front plate portion 30*a* of the ejector 18, in place of the box front plate 10*a* of the first embodiment, and a downstream side wall as a top plate portion 30*c* formed by the portion of the web 1 between the position of the nozzle 18*b* and a position 4*a* where the web 1 makes contact with the lower applicator roll 2*a*, in place of the box top plate 10*c* of the first embodiment, wherein the upstream side wall and the downstream side wall are arranged to abut on each other so as to form a cross sectional mountain shape elongating along the circumferential surface of the lower applicator roll 2*a*.

The front plate portion 30*a* of the ejector 18 has a length to cover approximately the entire width of the lower applicator roll 2*a* or at least the width to be coated of the web 1. The ejector 18 may be either integrally formed with the portions of the nozzles 18*a*, 18*b* or the portions of the nozzles 18*a*, 18*b* may be separately formed from each other to then be jointed together so that the space between them is closed.

As it is preferable that less air enters the box part 30, the box part 30 has each of its length-wise both end portions at both side end portions of the top plate portion 30*c* formed by the web 1 provided with a box end plate 30*b* so that the opening of the cross sectional mountain shape is closed. This construction is especially effective if the length of the box part 30 is not sufficiently ensured. Also, the respective lower edge portions of the ejector 18 and the box end plates 30*b* are preferably arranged closely to the circumferential surface of the lower applicator roll 2*a* coated with the coating liquid with a gap being formed therebetween so as not to directly make contact with each other. The box end plates 30*b* are preferably movable in the axial direction (width direction) of the lower applicator roll 2*a* so as to be positionable to meet the width of the top plate portion 30*c* formed by the web 1. In this case, no opening is formed at the end portions of the top plate portion 30*c* in the web width direction and the air can be more effectively prevented from entering the box part 30, like in the case of the second embodiment.

As shown in FIGS. 7 and 8, a vent hole 30*d* is preferably provided in the box part 30 and a vent pipe is at its one end connected to the vent hole 30*d* and at the other end connected to a suction device 12 so that gas b (usually air) in the box part 30 is sucked out. Or the vent pipe at the other end is connected with a steam supply device 13 so that steam c is supplied into the box part 30. The vent hole 30*d* may be provided at an appropriate position, not necessarily at a limited position, so as to pass through the box end plates 30*b* or the ejector 18 but, most effectively, the vent hole 30*d* as a discharge place of inflow air is provided in the box end plates 30*b* at both side ends of the box part 30 so that air or gas most smoothly flows in or flows out.

In the coating apparatus of the present embodiment constructed as mentioned above, the entrained air flow caused by the rotation of the lower applicator roll 2*a* is blocked by the ejector gas a ejected from the nozzle 18*a* of the ejector 18 as the first ejector and the entrained air flow caused by the running of the web 1 is blocked by the ejector gas a ejected from the nozzle 18*b* of the ejector 18 as the second ejector. Moreover, the side of the web 1 facing the lower applicator roll 2*a* on the upstream side of the nip portion 4 is directed to the interior of the box part 30, not to the outside. Hence, the entrained air flow is more effectively prevented from entering between the web 1 and the lower applicator roll 2*a*.

Also, by providing the nozzle 18*b* as the second ejector, in place of the blade 9, for blocking the entrained air flow on the web 1 side, the entrained air flow can be blocked without any element making contact with the web 1, and no problem arises regarding breakage of the web 1.

However, as the ejection of the ejector gas a is carried out by the two ejectors of the first and second ejectors, the negative pressure on the back side of the ejection is liable to increase. While the negative pressure in the box part 30 has an effect to accelerate the contact ability of the web 1 to the lower applicator roll 2*a*, if the box part 30 is open toward the surroundings thereof, the surrounding air will easily flow into the box part 30 so as to re-generate the entrained air flow and there arises a problem to reduce the effect of blocking the entrained air flow by the ejector 18.

Hence, the box end plate 30*b* is provided on each of the length-wise end portions of the box part 30 so as to close the opening of the cross sectional mountain shape and the respective lower edge portions of the nozzle 18*a* and the box end plates 30*b* are arranged closely to the circumferential surface of the lower applicator roll 2*a* coated with the coating liquid with a gap being formed therebetween so as not to make contact with each other. Thereby, inflow of the air into the box part 30 can be reduced and the re-generation of the entrained air flow caused by the air inflow can be prevented.

Here, like in the first embodiment, the construction is made such that the vent hole 30*d* is provided in the box part 30 so that one end of the vent pipe is connected to the vent hole 30*d* and the other end of the vent pipe is connected to the suction device 12 to thereby suck out the gas b (usually air) in the box part 30. Thus, the air entering the box part 30 is discharged outside and the re-generation of the entrained air flow caused by the inflow of the air can be more effectively prevented. Also, as the interior of the box part 30 can be maintained in a negative pressure, the top plate portion 30*c* formed by the web 1 is urged toward the lower applicator roll 2*a* and the contact ability of the web 1 to the lower applicator roll 2*a* is enhanced.

Or, one end of the vent pipe is connected to the vent hole 30*d* and the other end of the vent pipe is connected to the steam supply device 13 to thereby supply steam c into the box part 30. Thus, the air in the box part 30 is mostly replaced with the steam c and the interior of the box part 30 is maintained in a slightly positive pressure so that the inflow of the air is prevented. Also, even if an entrained flow of the steam is caused, the steam is condensed on the boundary layer of the surfaces of the lower applicator roll 2*a* and the web 1 to thereby generate a negative pressure there, so that the contact ability of the web 1 to the lower applicator roll 2*a* is enhanced. Also, the wetting ability of the web 1 is enhanced by the condensation of the steam, so that the applying rate of the coating liquid is increased and the quality of the coating is enhanced.

As the ejector gas a of the ejector 18, air can be generally used but if steam or inert gas is used, the same function and effect as described in the first embodiment can be obtained.

According to the present third embodiment also, not only the entrained air flow of the web 1 but also the entrained air flow of the lower applicator roll 2*a* can be removed. Thereby, the web 1 is not prevented from making contact with the coating liquid, the contact ability of the web 1 to the lower applicator roll 2*a* is enhanced, the coating irregularity and the misting are reduced and the coating state of the web 1 is enhanced.

Also, by the coating state on the upstream side of the nip portion 4 being so improved, the coating state on the upstream side of the nip portion 4 and that on the downstream side of the nip portion 4 can be easily equalized with each other and a uniform coating state of high quality can be realized on both sides of the web 1.

In the above, while the present invention has been described based on the embodiments, it is a matter of course that the present invention is not limited to the embodiments but may be added with various modifications in the concrete construction thereof within the scope of the claims of the present invention as appended herein.

For example, the upper side and lower side arrangement of the devices of each of the embodiments as illustrated is only an example and the arrangement may be turned upside down with each of the coater heads being re-arranged corresponding thereto. In this case, the box top plate 10*c* and the top plate portions 20*c*, 30*c* of the box parts 10, 20, 30, respectively, are not necessarily needed to be arranged on the upper portion of the applicator roll but may be arranged on the lower portion of the applicator roll. In this case also, these top plate members well function to cover a portion of the circumferential surface of the applicator roll.

Figure 10:
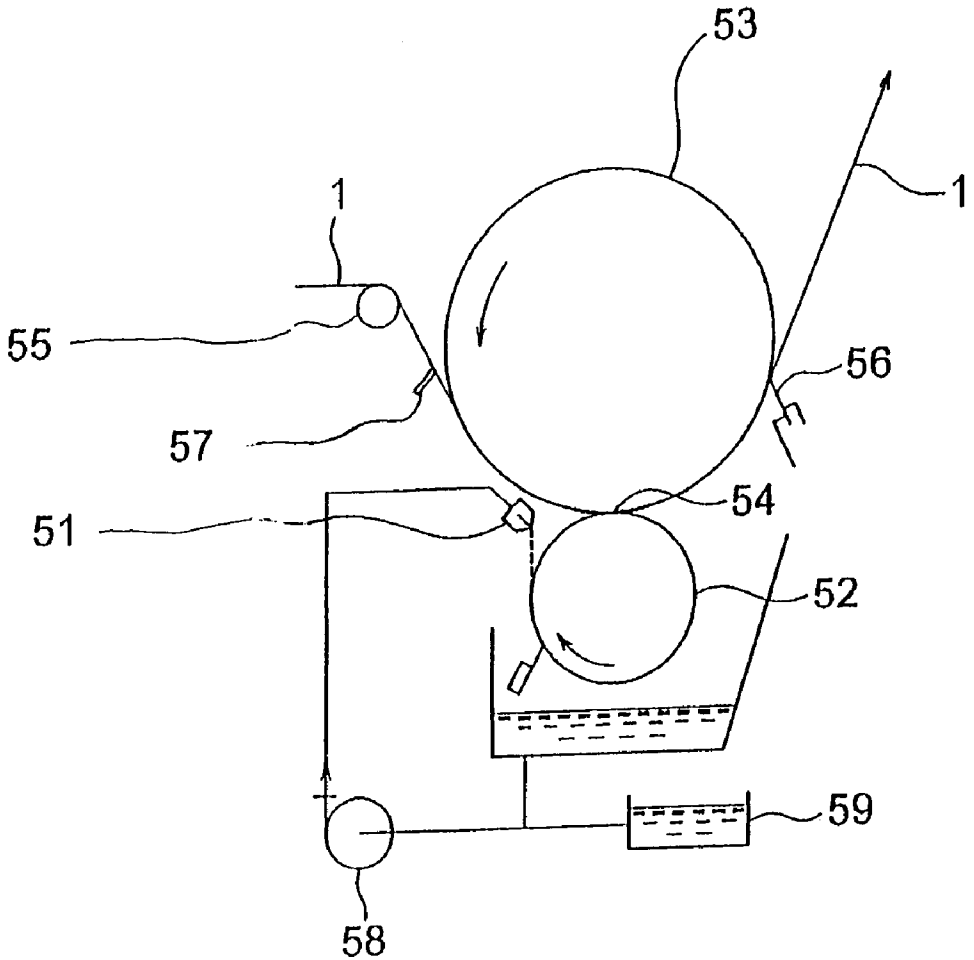
Fig. 10 (Prior Art)
FIG. 10 is a schematic side view of another prior art example of a coating apparatus.

Also, in all of the above-mentioned embodiments, the description has been made of the coating apparatuses comprising the two applicator rolls arranged to abut on each other so as to form the nip portion therebetween and to transfer the coating liquid applied to the surfaces of the applicator rolls to be coated on the surface of the web passing through the nip portion. However, the present inventions described above are not limited to these coating apparatuses but, as shown in FIG. 10 showing the prior art device, for example, the present inventions may be also applied to such a coating apparatus as comprises one applicator roll ("one applicator roll" in the present invention) arranged to abut on a backing roll (one kind of "another roll" in the present invention) so as to form a nip portion therebetween and to transfer a coating liquid applied to a surface of the applicator roll to be coated on a surface of a web passing through the nip portion and substantially the same function and effect can be obtained. In this case, as a matter of course, the coating apparatus may have a coating liquid supply device not necessarily of such a type as the curtain die shown in FIG. 10 but such one as the coating liquid supply device having a coater head or the like.

Nevertheless, the function and effect of the present invention are most effectively obtained in such a coating apparatus as comprises two applicator rolls arranged to abut on each other so as to form a nip portion therebetween and to transfer a coating liquid applied to surfaces of the applicator rolls to be coated on a surface of a web passing through the nip portion, whereby the coating state on the upstream side of the nip portion is improved and the coating state on the upstream side of the nip portion and that on the downstream side of the nip portion are easily equalized to each other. Thereby, the coating state of both sides of the web is equalized and the quality of the coating can be enhanced.

Also, the present invention is not limited to the embodiments in which the web is transferred being wound around the applicator roll but may be also applied to such a coating apparatus as having the web arranged to pass through the nip portion in the tangential direction thereof, like the web 1 shown by the dotted lines in FIGS. 1, 5, 7 and 9, and substantially the same function and effect can be obtained.

Generally, in a coating apparatus comprising an applicator roll arranged to abut on another roll so as to form a nip portion therebetween and to transfer a coating liquid applied to a surface of the applicator roll to be coated on a surface of a web passing through the nip portion, the nip force is changed so as to control a transfer rate of the coating liquid onto the surface of the web. Thus, in order to make the apparatus improved to meet a high velocity operation while the coating performance is being maintained, it is necessary to prevent an entrained air flow on the surfaces of the web and the applicator roll from increasing corresponding to the high velocity and, for this purpose, it is necessary to increase the nip force. But then, because of the high nip force, there arises a problem in that a predetermined film thickness of the coating liquid can be hardly formed. Nevertheless, according to the coating apparatuses of the present inventions described above, the boundary air removers are provided and thereby the entrained air flow caused by the high velocity operation of the apparatus can be prevented from entering the nip portion. Hence, the nip force is not needed to be excessively increased and coating of a predetermined film thickness becomes possible.

What is claimed is:

1. A coating apparatus comprising:

an applicator roll arranged to abut on another roll so as to form a nip portion therebetween, and arranged to transfer a coating liquid applied to a surface of said applicator roll to be coated on a surface of a web passing through said nip portion;

a coating head provided on an upstream side of said nip portion in a rotational direction of said applicator roll so as to supply the coating liquid onto the surface of said applicator roll; and a boundary air remover provided between said nip portion and said coating head on the upstream side of said nip portion so as to prevent air from entering said nip portion, said boundary air remover comprising a box part having a length larger than a width to be coated of said web part, the box part being arranged so as to cover a portion of the surface of said applicator roll along an axial direction of said applicator roll, and an ejector for ejecting an ejector gas onto the surface of said applicator roll in a direction opposite to the rotational direction of said applicator roll.

2. A coating apparatus as claimed in claim 1, wherein said ejector gas is steam.

3. A coating apparatus as claimed in claim 1, wherein an ejecting direction of a nozzle of said ejector is in a range of 10° to 45° relative to a tangential direction of said applicator roll.

4. A coating apparatus as claimed in claim 1, wherein said boundary air remover further comprises:

a blade provided on the upstream side of said nip portion in a running direction of said web so as to extend in a width direction of said web and so as to make contact with a side surface of said web that makes contact with the surface of said applicator roll.

5. A coating apparatus as claimed in claim 4, wherein said boundary air remover further comprises:

a box front plate arranged to close a space between said ejector and said blade; and a top plate portion formed by a portion of said web between a position where said web makes contact with said blade and a position where said web makes contact with said applicator roll so that said box front plate, said blade and said top plate portion form said box part between said nip portion and said ejector on the upstream side of said nip portion in the rotational direction of said applicator roll, wherein said box front plate and said ejector are provided closely to said applicator roll coated with the coating liquid with a gap being maintained therebetween so as not to make contact with each other.

6. A coating apparatus as claimed in claim 4, wherein said boundary air remover further comprises:

a box front plate arranged to close a space between said ejector and said blade; and a box top plate provided on a downstream side of said box front plate and connected to said box front plate so as to extend toward a position where said web makes contact with said applicator roll so that said box front plate and said box top plate form said box part between said nip portion and said ejector on the upstream side of said nip portion in the rotational direction of said applicator roll, wherein said box front plate and said ejector are provided closely to said applicator roll coated with the coating liquid with a gap being maintained therebetween so as not to make contact with each other.

7. A coating apparatus as claimed in claim 1, wherein said ejector comprises a first ejector, and wherein said boundary air remover further comprises:

a second ejector provided on the upstream side of said nip portion in a running direction of said web so as to eject an ejector gas onto a side surface of said web that makes contact with the surface of said applicator roll;

a front plate portion arranged to close a space between said first ejector and said second ejector; and a top plate portion formed by a portion of said web between a position where said web faces said second ejector and a position where said web makes contact with said applicator roll so that said front plate portion and said top plate portion form said box part between said nip portion and said first and second ejectors on the upstream side of said nip portion in the rotational direction of said applicator roll, wherein said front plate portion and said first ejector are provided closely to said applicator roll coated with the coating liquid with a gap being maintained therebetween so as not to make contact with each other, and wherein said second ejector is provided closely to said web with a gap being maintained therebetween so as not to make contact with each other.

8. A coating apparatus as claimed in claim 7, wherein an ejecting direction of a nozzle of said second ejector is in a range of 10° to 45° relative to the surface of said web.

9. A coating apparatus as claimed in claim 5, wherein said boundary air remover comprises box end plates provided at two end portions of said box part, respectively, in the axial direction of said applicator roll, said box end plates being provided closely to said applicator roll coated with the coating liquid with a gap being maintained therebetween so as not to make contact with each other.

10. A coating apparatus as claimed in claim 9, wherein said box end plates are arranged so as to be movable in the axial direction of said applicator roll.

11. A coating apparatus as claimed in claim 9, wherein said boundary air remover further comprises a vent hole provided on said box part and connected to a suction device for sucking out gas in said box part.

12. A coating apparatus as claimed in claim 9, wherein said boundary air remover further comprises a vent hole provided on said box part and connected to a steam supply device for supplying steam into said box part.

13. A coating apparatus as claimed in claim 6, wherein said boundary air remover comprises box end plates provided at two end portions of said box part, respectively, in the axial direction of said applicator roll, said box end plates being provided closely to said applicator roll coated with the coating liquid with a gap being maintained therebetween so as not to make contact with each other.

14. A coating apparatus as claimed in claim 7, wherein said boundary air remover comprises box end plates provided at two end portions of said box part, respectively, in the axial direction of said applicator roll, said box end plates being provided closely to said applicator roll coated with the coating liquid with a gap being maintained therebetween so as not to make contact with each other.

15. A coating apparatus as claimed in claim 13, wherein said box end plates are arranged so as to be movable in the axial direction of said applicator roll.

16. A coating apparatus as claimed in claim 14, wherein said box end plates are arranged so as to be movable in the axial direction of said applicator roll.

17. A coating apparatus as claimed in claim 13, wherein said boundary air remover further comprises a vent hole provided on said box part and connected to a suction device for sucking out gas in said box part.

18. A coating apparatus as claimed in claim 14, wherein said boundary air remover further comprises a vent hole provided on said box part and connected to a suction device for sucking out gas in said box part.

19. A coating apparatus as claimed in claim 13, wherein said boundary air remover further comprises a vent hole provided on said box part and connected to a steam supply device for supplying steam into said box part.

20. A coating apparatus as claimed in claim 14, wherein said boundary air remover further comprises a vent hole provided on said box part and connected to a steam supply device for supplying steam into said box part.

21. A coating apparatus as claimed in claim 1, wherein said applicator roll comprises a first applicator roll and said another roll comprises a second applicator roll, said coating apparatus further comprising:

an air levitating type turn bar arranged on a downstream side of said nip portion such that said web is wound around a surface of one of said first and second applicator rolls after passing through said nip portion; and a paper roll arranged on the upstream side of said nip portion in a running direction of said web such that said web is wound around a surface of the other of said first and second applicator rolls before entering said nip portion, wherein said boundary air remover is arranged between said web and said other of said first and second applicator rolls on an upstream side of a position where said web makes contact with the surface of said other of said first and second applicator rolls so as to prevent air from entering said nip portion.

* * * * *